US008485171B2

(12) United States Patent
Romney

(10) Patent No.: US 8,485,171 B2
(45) Date of Patent: Jul. 16, 2013

(54) APPARATUSES FOR LAUNCHING PROJECTILES

(75) Inventor: Devon Romney, Newman Lake, WA (US)

(73) Assignee: Airow X Sports, LLC, Eugene, OR (US)

( * ) Notice: Subject to any disclaimer, the term of this patent is extended or adjusted under 35 U.S.C. 154(b) by 501 days.

(21) Appl. No.: 12/224,450

(22) PCT Filed: Mar. 7, 2007

(86) PCT No.: PCT/US2007/005913

§ 371 (c)(1), (2), (4) Date: Feb. 4, 2009

(87) PCT Pub. No.: WO2008/048359

PCT Pub. Date: Apr. 24, 2008

(65) Prior Publication Data

US 2010/0024791 A1 Feb. 4, 2010

Related U.S. Application Data

(60) Provisional application No. 60/780,273, filed on Mar. 7, 2006.

(51) Int. Cl.
*F41B 11/00* (2006.01)

(52) U.S. Cl.
USPC ..... 124/65

(58) Field of Classification Search
USPC ..... 124/65–77
See application file for complete search history.

(56) References Cited

U.S. PATENT DOCUMENTS

| | | | | | |
|---|---|---|---|---|---|
| 213,616 | A | | 3/1879 | Bowles | |
| 1,526,176 | A | | 2/1924 | O'Connell | |
| 2,069,821 | A | * | 2/1937 | Douglas | 124/67 |
| 2,214,224 | A | * | 9/1940 | Douglas | 124/67 |
| 2,757,657 | A | * | 8/1956 | Lohmeyer | 124/67 |
| 3,561,419 | A | * | 2/1971 | Cucuzza, Sr. | 124/25 |
| 3,572,311 | A | | 3/1971 | Baer | |
| 4,027,645 | A | | 6/1977 | Damron | |
| 4,146,009 | A | | 3/1979 | Adams | |
| 4,261,321 | A | * | 4/1981 | Nishioka | 124/67 |
| 4,291,664 | A | | 9/1981 | Nishioka | |
| 4,446,844 | A | | 5/1984 | Nishioka | |
| 4,625,706 | A | * | 12/1986 | Turner, Jr. | 124/67 |
| 4,708,341 | A | | 11/1987 | Paraskevakos | |
| 4,742,812 | A | * | 5/1988 | Goodman | 124/25 |
| 5,224,464 | A | * | 7/1993 | Burnham et al. | 124/67 |
| 5,228,427 | A | * | 7/1993 | Gardner, Jr. | 124/71 |
| 5,242,323 | A | * | 9/1993 | Rappaport | 446/180 |
| 5,373,833 | A | * | 12/1994 | D'Andrade | 124/69 |
| 5,522,374 | A | * | 6/1996 | Clayton | 124/59 |
| 5,649,521 | A | | 7/1997 | King | |
| 5,678,528 | A | * | 10/1997 | Hadley | 124/25 |
| 5,680,853 | A | * | 10/1997 | Clayton | 124/66 |
| 5,704,342 | A | * | 1/1998 | Gibson et al. | 124/73 |

(Continued)

*Primary Examiner* — Bret Hayes
(74) *Attorney, Agent, or Firm* — Wells St. John P.S.

(57) ABSTRACT

An apparatus for launching projectiles. The apparatus includes a hollow cylinder and a piston in sliding engagement through the hollow cylinder. The piston is configured to drive a fluid through the hollow cylinder. The apparatus further includes a barrel defining an open end and a chamber in fluid communication with the hollow cylinder. The chamber is configured to receive a projectile and to receive fluid driven from the hollow cylinder wherein the projectile is driven from the barrel through the open end.

24 Claims, 15 Drawing Sheets

U.S. PATENT DOCUMENTS 5,711,284 A 1/1998 Keenan, Jr.
6,273,078 B1 * 8/2001 Schwesinger ..... 124/16
6,752,136 B1 6/2004 Anderson
6,997,770 B2 2/2006 Lapointe
7,451,755 B2 * 11/2008 Dobbins et al. ..... 124/71
2003/0041849 A1 * 3/2003 Perry et al. ..... 124/84
2005/0091901 A1 * 5/2005 Perry et al. ..... 42/78
2005/0188974 A1 * 9/2005 Pedicini et al. ..... 124/65
2006/0260597 A1 * 11/2006 Anderson ..... 124/83

* cited by examiner

APPARATUSES FOR LAUNCHING PROJECTILES

RELATED PATENT DATA

This application is a 35 U.S.C. §371 of and claims priority to PCT International Application Serial Number PCT/US2007/005913, which was filed Mar. 7, 2007, and was published in English, which claims priority under 35 U.S.C. §119 to U.S. Provisional Patent Application No. 60/780,273, which was filed Mar. 7, 2006, the entirety of each are incorporated herein by reference.

TECHNICAL FIELD

The invention pertains to apparatuses and methods for launching projectiles.

BACKGROUND OF THE INVENTION

Different launching or firing devices eject or expel different respective projectiles. For example, archery bows launch arrows, firearms fire bullets, paintball guns launch paintballs, pellet and/or air guns launch pellets and/or BBs, and dart guns launch darts. There is a need to have an apparatus that provides the capability to launch a variety of projectiles from a single launching or firing device.

BRIEF DESCRIPTION OF THE DRAWINGS

Preferred embodiments of the invention are described below with reference to the following accompanying drawings.

FIG. 8 is an exploded view of another exemplary one of the various modular structures for launching projectiles according to another of the various embodiments of the invention.

FIG. 13 is the modular structure of FIG. 12 in a method step according to one of the various embodiments of the invention.

FIG. 14 is an exploded view of an exemplary one of the various modular structures for launching projectiles according to one of the various embodiments of the invention.

FIG. 16 is an upright side perspective view of the exemplary projective loading device of FIG. 15.

FIG. 17 is a plan view of the underside of the exemplary projective loading device of FIG. 15.

FIG. 18 is a vertical cross-sectional view of the exemplary projective loading device of FIG. 15.

SUMMARY OF THE INVENTION

One aspect of the invention includes an apparatus for launching projectiles, the apparatus includes a hollow cylinder and a piston in sliding engagement through the hollow cylinder. The piston is configured to drive a fluid through the hollow cylinder. The apparatus further includes a barrel defining an open end and a chamber in fluid communication with the hollow cylinder. The chamber is configured to receive a projectile and to receive fluid driven from the hollow cylinder wherein the projectile is driven from the barrel through the open end.

Another aspect of the invention includes a method for launching projectiles, the method includes providing a first modular structure configured to force a fluid through the first modular structure. The method includes securing a second modular structure in fluid communication with the first modular structure. The second modular structure is configured to receive the fluid forced from the first modular structure. Moreover, the second modular structure defines a chamber to receive a projectile in a relationship wherein the fluid forced from the first modular structure is capable of launching the projectile from the second modular structure.

DETAILED DESCRIPTION OF THE PREFERRED EMBODIMENTS

This disclosure of the invention is submitted in furtherance of the constitutional purposes of the U.S. Patent Laws "to promote" the progress of science and useful arts" (Article 1, Section 8).

Figure 1:
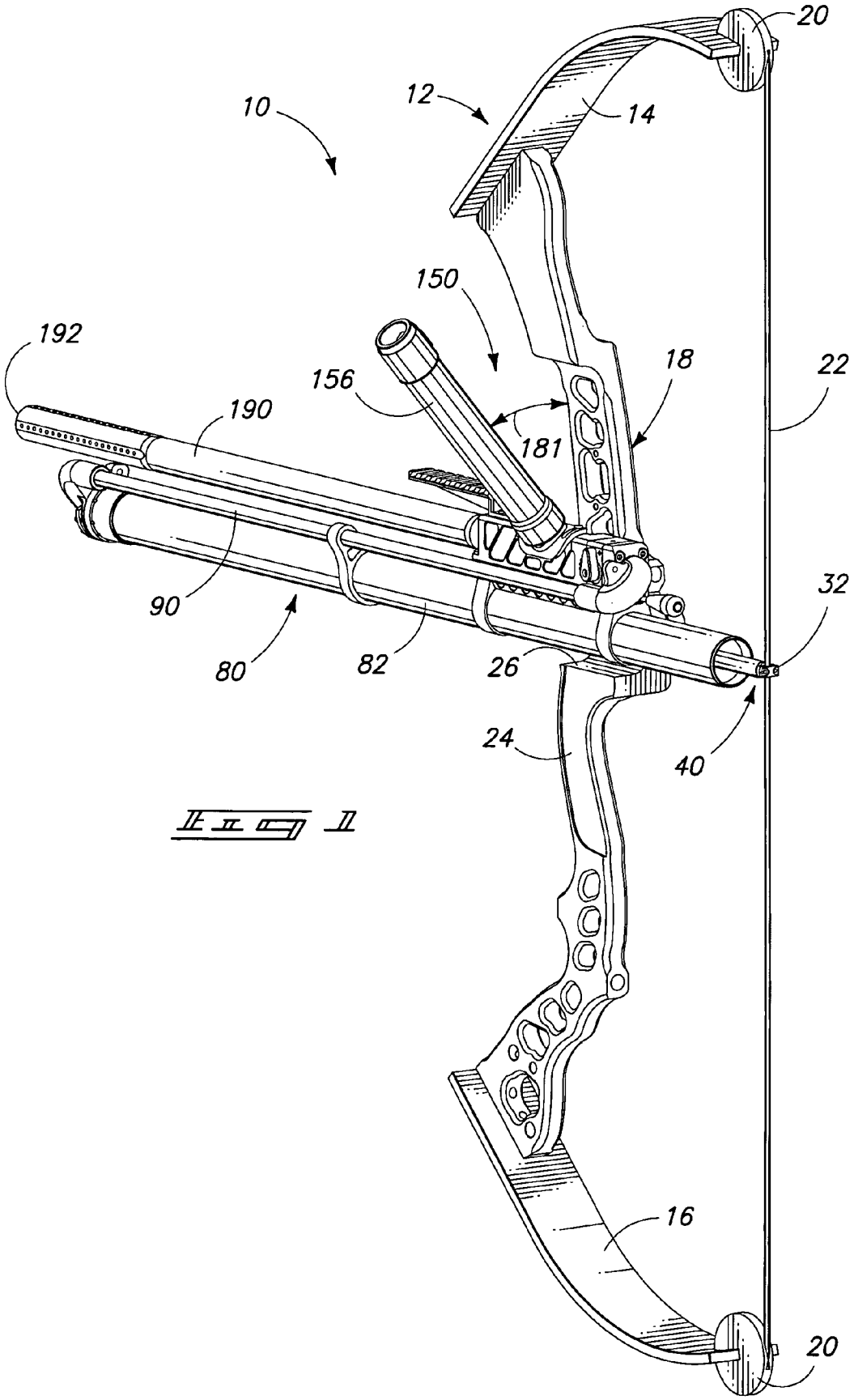
FIG. 1 is a perspective view of an exemplary apparatus for launching projectiles according to one of various embodiments of the invention.

FIG. 1 illustrates an exemplary one of various embodiments of an apparatus 10 for launching or firing a projectile according to an embodiment of the invention. Apparatus 10 is secured to an archery bow 12. Archery bow 12 can be any range of different styles of bows, for example, a compound bow, a recurve bow and a crossbow. Another exemplary style for archery bow 12 is a long bow if the handle or riser is constructed sufficiently to support inventive apparatus 10. An exemplary archery bow 12 is the conventional compound bow illustrated in a simplified form and includes a riser 18 having respective limbs 14 and 16 extending from opposite sides of the riser 18. Each limb has a pulley 20 (wheel and/or cam) to receive drawstring 22. An exemplary riser 18 includes a handle 24 and arrow rest 26.

Still referring to FIG. 1, an exemplary apparatus 10 includes a fluid transference device or compression tube 80 that includes a cylinder 82. An exemplary cylinder 82 is positioned elevationally above arrow rest 26 and extends substantially longitudinally outward from archery bow 12 generally as an arrow (not shown) would extend if supported on the arrow rest 26. An exemplary cylinder 82 is a hollow structure to receive an exemplary piston device 40 (described more thoroughly subsequently). Piston device 40 is secured to drawstring 22 wherein piston device 40 slidingly engages cylinder 82. An exemplary piston device 40 includes an end with an attachment device 32 that secures piston rod 42 to drawstring 22 of archery bow 12 and is illustrated as two halves attached by a pair of screws. An exemplary fluid transference device or compression tube 80 includes a tube 90 in fluid communication with cylinder 82.

Still referring to FIG. 1, an exemplary tube 90 extends from cylinder 82 to an exemplary projectile loading device 150 (discussed more thoroughly subsequently). An exemplary tube 90 is hollow and provides fluid communication between cylinder 82 and projectile loading device 150. An exemplary hollow portion of the tube 90 comprises a diameter that is smaller than a diameter of the hollow portion of cylinder 82, and therefore, fluid driven from cylinder 82 into projective loading device 150 will travel at a greater velocity through tube 90 than a velocity through cylinder 82. An exemplary barrel 190 extends from projective loading device 150 and is in fluid communication with projective loading device 150, tube 90 and fluid transference device 80. It should be understood that any exemplary barrel discussed in this document can have any configuration to launch or eject any configuration of projectile, for example, bullets of any caliber, paintballs, pellets, BBs, and darts. It should be further understood that an exemplary fluid to drive an exemplary projectile includes any gas, such as air.

In operation (described more thoroughly subsequently), an exemplary projectile is provided by projective loading device 150 into a chamber (discussed subsequently) wherein fluid driven from cylinder 82 by piston device 40 will increase in velocity through tube 90 and travel to impact the projectile which will launch or eject the projectile through an open end 192 of barrel 190. An exemplary projectile loading device 150 includes a projectile housing 152 that can hold a plurality of projectiles. An exemplary projectile for apparatus 10 is a paintball wherein exemplary barrel 190 is configured to have a paintball travel down the barrel 190 under the pressure and force of the compressed volume of air that originated from the compression tube 80. An exemplary housing or hopper 156 will hold a plurality of paint balls, for example, one to ten paint balls. Moreover, an exemplary embodiment of hopper 156 will be able to pivot or move over a range of from about 0° (arbitrarily representing vertical) to about 50°. Stated another way, the hopper 156 will be able to pivot from adjacent the riser 18 of archery bow 12 in a direction 181 of about 50° from riser 18. An exemplary apparatus 10 is capable of launching a paintball at a velocity having a range of from about 200 feet per second to about 325 feet per second.

Figure 2:
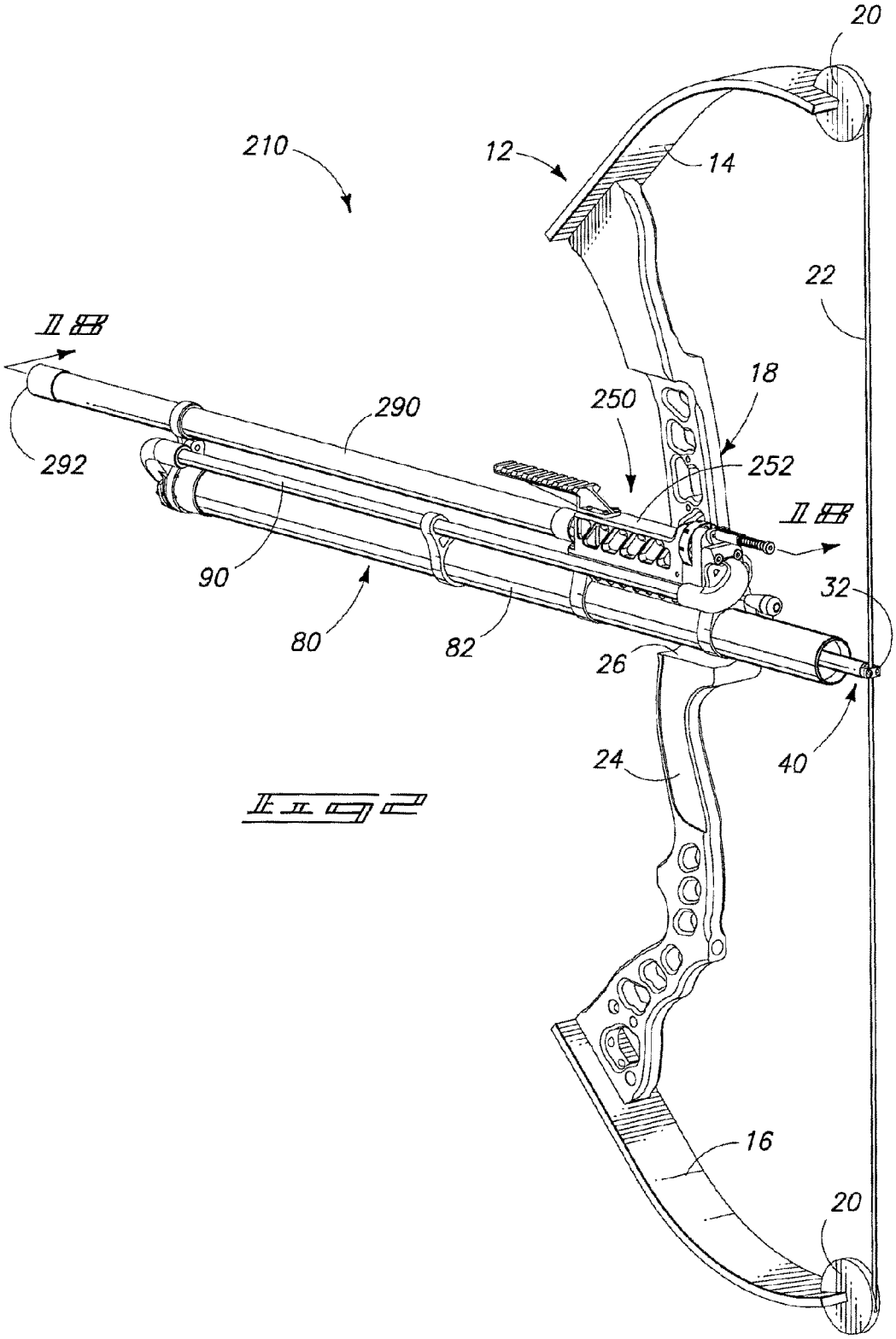
FIG. 2 is a perspective view of another exemplary apparatus for launching projectiles according to another one of various embodiments of the invention.

FIG. 2 illustrates another exemplary one of various embodiments of an apparatus 210 for launching or ejecting a projectile according to an embodiment of the invention. The structures and device that exist in this exemplary embodiment of apparatus 210 and which also exist in the previous-described embodiment of apparatus 10 for FIG. 1 will have the same reference numbers. It should be understood all discussion and description previously presented regarding the same structures and devices for apparatus 10 is applicable to this embodiment of apparatus 210. The same exemplary archery bows 12 can be used with this exemplary embodiment of apparatus 210. Moreover, an exemplary embodiment of apparatus 210 includes fluid transference device or compression tube 80 which includes tube 90 and piston device 40.

Still referring to FIG. 2, apparatus 210 includes the tube 90 extending from cylinder 82 to an exemplary projectile loading device 250 (discussed more thoroughly subsequently). Cylinder 82, tube 90 and projectile loading device 250 are in fluid communication. An exemplary outer or support barrel 290 (an inner barrel discussed subsequently) extends from projective loading device 250 and is in fluid communication with projective loading device 250. In operation, an exemplary projectile is provided by projective loading device 250 into a chamber (discussed subsequently) wherein fluid driven through cylinder 82 by piston device 40 will increase in velocity through tube 90 and travel to impact the projectile which will launch or eject the projectile through an open end 292 of outer barrel 290. An exemplary projectile loading device 250 includes a projectile housing 252 that can hold a plurality of projectiles. An exemplary projectile for apparatus 210 is a pellet. Moreover, an exemplary apparatus 210 is capable of launching a pellet at a velocity having a range of from about 500 feet per second to about 1,000 feet per second.

Figure 3E:
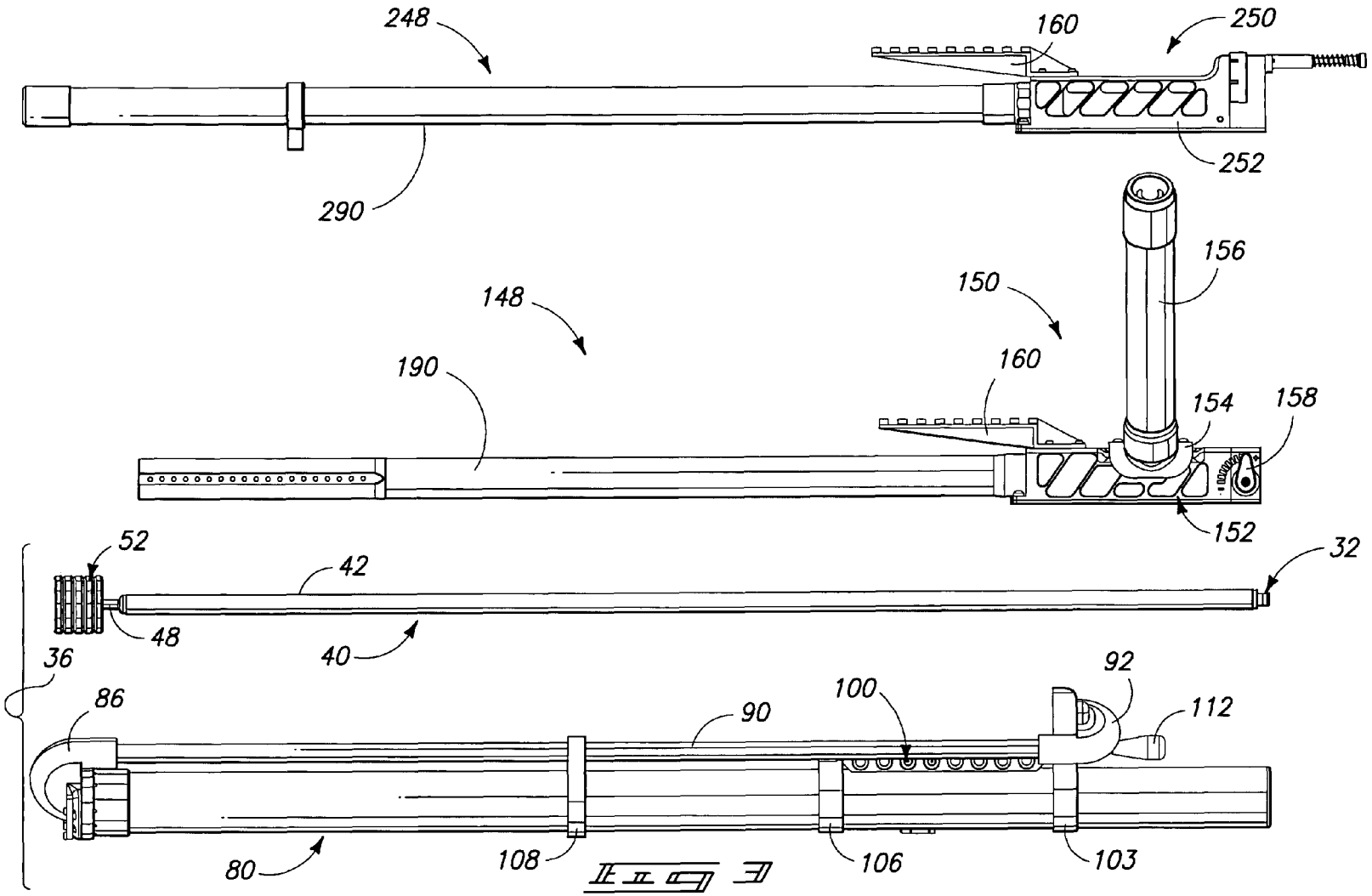
FIG. 3 is a side view of various modular structures for launching projectiles according to one of various embodiments of the invention.

Referring to FIG. 3, the modular design and configuration of the structures for respective exemplary embodiments of apparatuses 10 and 210 is illustrated. It should be understood that the compression tube 80 and piston device 40 are included in both exemplary apparatuses 10 and 210. Accordingly each exemplary embodiment of apparatuses 10 and 210 are modular designs with two modular structures. That is, the combination of the compression tube 80 and piston device 40 is a first modular structure 36 for respective embodiments of apparatuses 10 and 210. The combination of projectile loading mechanism 150 and barrel 190 is a second modular structure 148 for apparatus 10. Moreover, the combination of projectile loading mechanism 250 and outer barrel 290 is a second modular structure 248 for apparatus 210.

Figure 4:
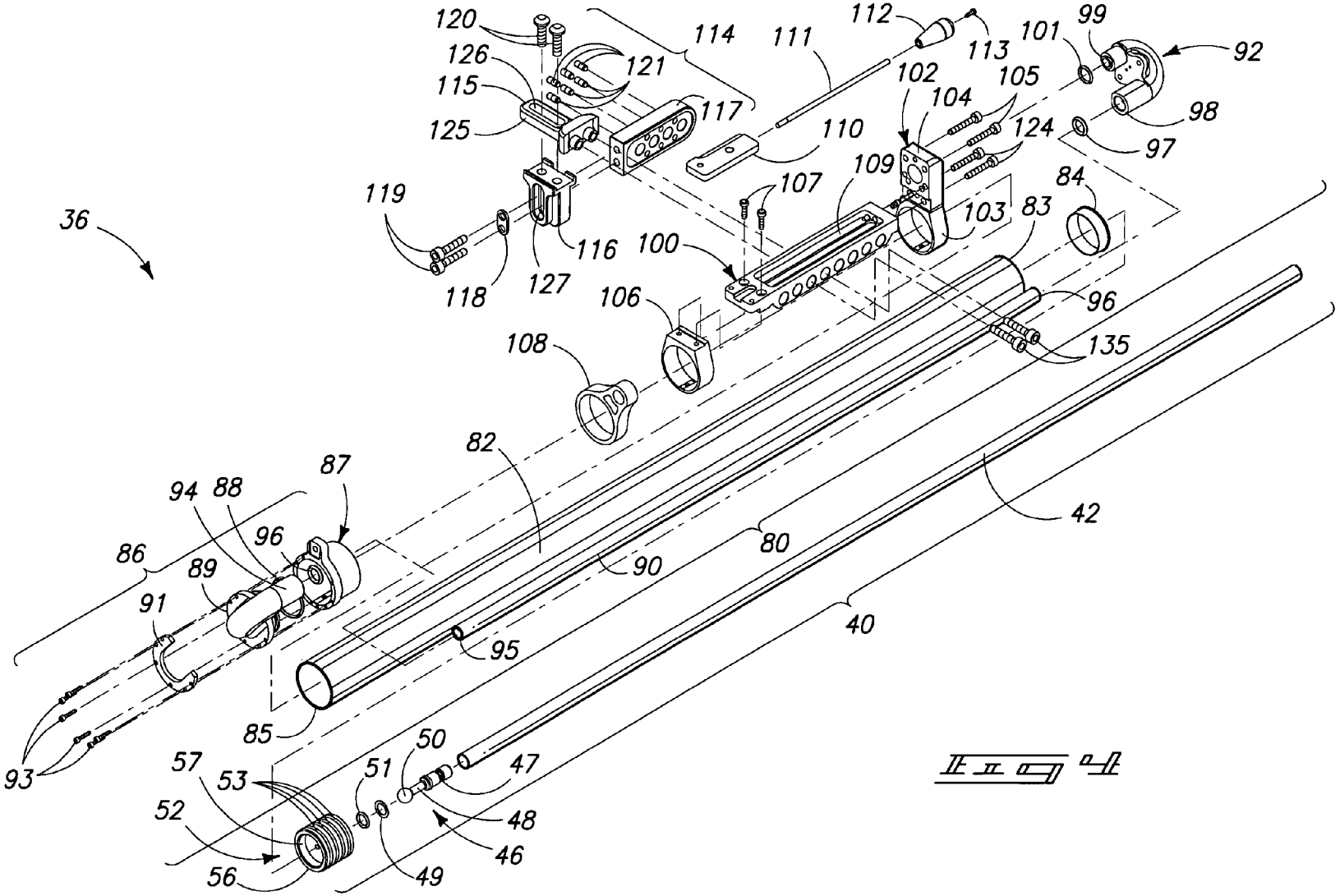
FIG. 4 is an exploded view of an exemplary one of the various modular structures for launching projectiles according to one of various embodiments of the invention.

Referring to FIG. 4, the exemplary first modular structure 36 is illustrated according to one embodiment of the invention, which as stated previously, includes piston device 40 and compression tube 80. Bearing 46 of piston device 40 is more thoroughly illustrated and has a rear portion 47 that is to be secured in piston rod 42. Bearing 46 further includes a neck or stem 48 extending from the rear portion 47 and a ball portion 50 on an end of stem 48 opposite the rear portion 47. Ball portion 50 is to be received in piston head 52 along with retaining ring 49 and oaring 51 wherein a pivoting relationship is established between ball portion 50 and piston head 52. Piston head has an outer periphery defining a plurality of circumferential grooves 53 spaced along the length of the piston head 52. An end of the piston head 52 opposite the piston rod 42 defines a rim 56 surrounding a cavity 57.

Still referring to FIG. 4, compression tube 80 includes the cylinder 82 having a first end 83 opposite a second end 85. A first end 83 of cylinder 82 has a collar 84 that reduces the diameter of cylinder 82 to prevent piston head 52 from sliding out of cylinder 82 when positioned therein. A first fluid elbow 86 is secured on end 85 of cylinder 82. An exemplary first fluid elbow 86 has a flange 87 that secures a reduced tubular portion 89 and o-ring 88 to end 85 of cylinder 82. An exemplary reduced tubular portion 89 is secured to flange 87 by support plate 91 and a plurality of screws 93. The reduced tubular portion 89 terminates to form a cylindrical end 94 to be received over a first end 95 of tube 90 with o-ring 96. It should be understood that reduced tubular portion 89 has a decreasing diameter from flange 87 to the cylinder end 94. Accordingly, reduced tubular portion 89 reduces the diameter of cylinder 82 so that as fluid is being forced through cylinder 82 by piston device 40 to tube 90, decreasing diameters will increase the velocity of the movement of the air. It should be further understood that reduced tubular portion 89 changes the fluid flow direction 180°.

Still referring to FIG. 4, a second end 96 of tube 90 opposite first end 95 is secured to a first open end 98 of a second fluid elbow 92 and o-ring 97. An exemplary second fluid elbow 92 changes the fluid flow direction 180° and has a second open end 99 with an o-ring 101 to be secured to a base end plate 102. An exemplary base end plate 102 has a first collar portion 103 be received over an outer periphery of cylinder 82 wherein second fluid elbow 92 is secured relative to or adjacent to cylinder 82. An exemplary base end plate 102 also secures a base plate 100 adjacent and/or against cylinder 82. The base end plate 102 has a block portion 104 extending from collar portion 103 which receives screws 124 to secure base plate 100. Moreover, the block portion 104 of base end plate 102 will receive screws 105 to secure respective projectile loading mechanisms 150 and 250 to the first modular structure 36. Correspondingly, screws 105 will secure respective second modular structures 148 and 248 of respective apparatuses 10 and 210 to the first modular structure 36.

Still referring to FIG. 4, a second collar 106 secures an end of the base plate 100 with a plurality of screws 107 to cylinder 82, the end being opposite the base end plate 102. A third collar 108 is positioned between base plate 100 and first fluid elbow 86 and secures tube 90 spaced relative to cylinder 82. An exemplary base plate 100 defines a rectangular cavity 109 extending longitudinally in an upper portion of base plate 100. An exemplary cavity 109 is configured to receive a base slide 110 that will move axially in cavity 109 of base plate 100. A slide rod 111 has one end secured to base slide 110 and an opposite end secured to a slide handle or knob (or lever) 112 by a screw 113. An exemplary slide rod 111 will extend in sliding engagement through a portion of base plate 100 and through the block portion 104 of base end plate 102. Accordingly, axially moving slide knob 112 will move base slide 110 axially within cavity 109.

Still referring FIG. 4, a bow mount 114 will secure the first modular structure 36 to the riser 18 of archery bow 12. An exemplary bow mount 114 includes a mounting bracket 115 secured to a side wall of base plate 100 by screws 135. An exemplary mounting bracket 115 has a lateral unshaped extension. An exemplary unshaped extension defines a slot 126 to receive screws 120 for securing a bracket adjustment device 116 to a bottom portion of mounting bracket 115. Slot 126 of mounting bracket 115 allows for axially adjusting and securing, along slot 126, of bracket adjustment device 116. An exemplary bracket adjustment device 116 defines a slot 127 to be oriented substantially perpendicular to slot 126 of mounting bracket 115. Slot 127 of bracket adjustment device 116 receives screws 119 and adjustment plate 118 to secure a riser plate 117 to bracket adjustment device 116. Slot 127 of bracket adjustment device 116 allows for axially adjusting and securing, along slot 127, of riser plate 117 in a generally perpendicular relationship to mounting bracket 115. A plurality of set screws 121 is provided into riser plate 117.

Figure 5:
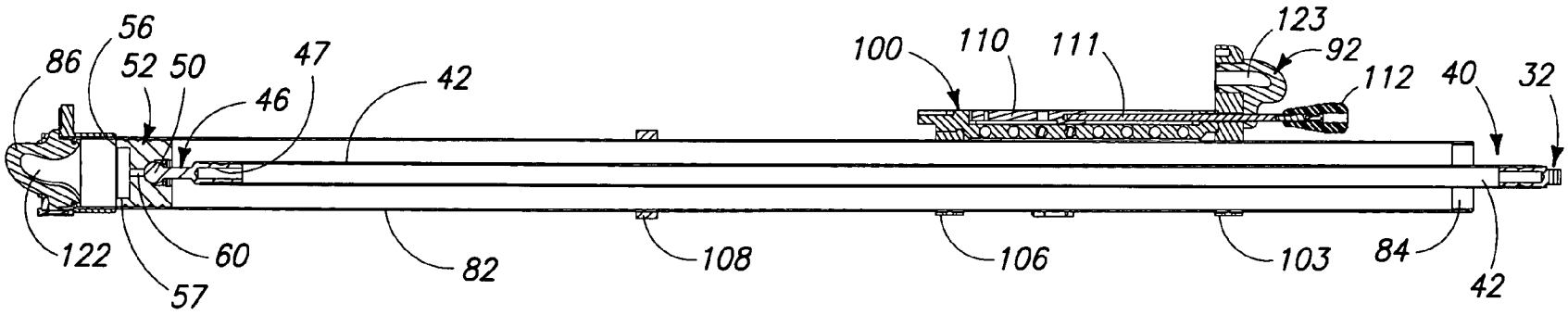
FIG. 5 is a vertical cross-sectional view of a compression tube of FIG. 4.

Referring to FIG. 5, sectional views are illustrated of first and second fluid elbows 86 and 92, base plate 100, and piston device 40 slidingly engaging or cooperating in cylinder 82. Respective cavities 122 and 123 are illustrated for first and second fluid elbows 86 and 92.

Figure 6:
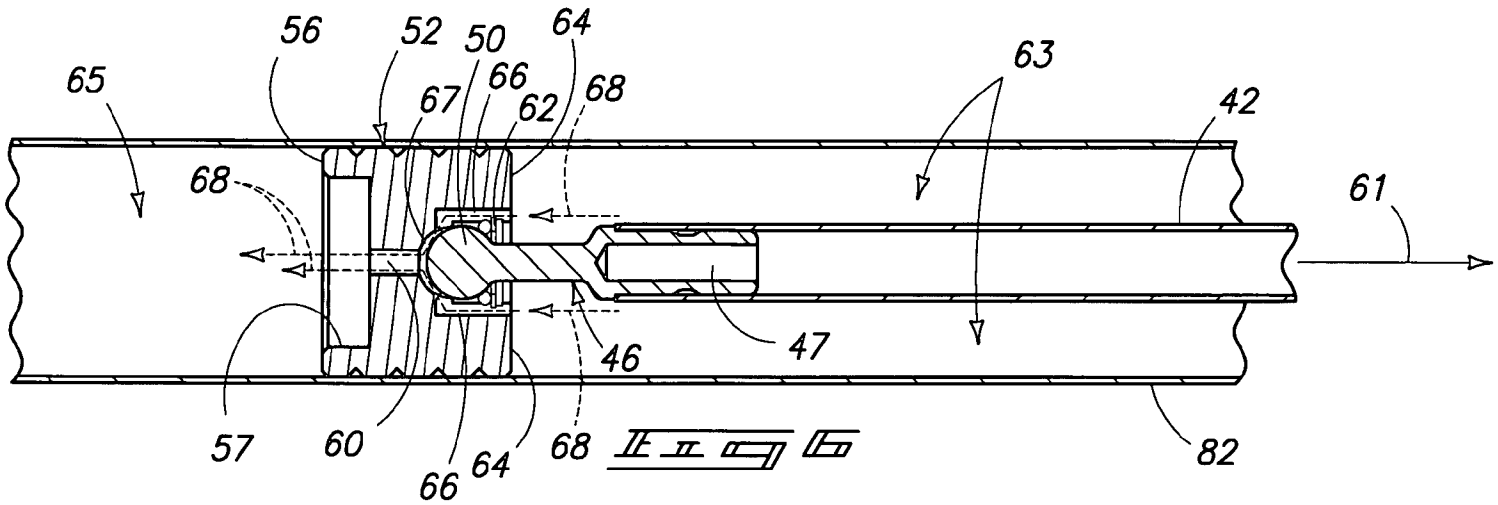
FIGS. 6-7 are fragmentary views of the compression tube of FIG. 5.
Figure 7:
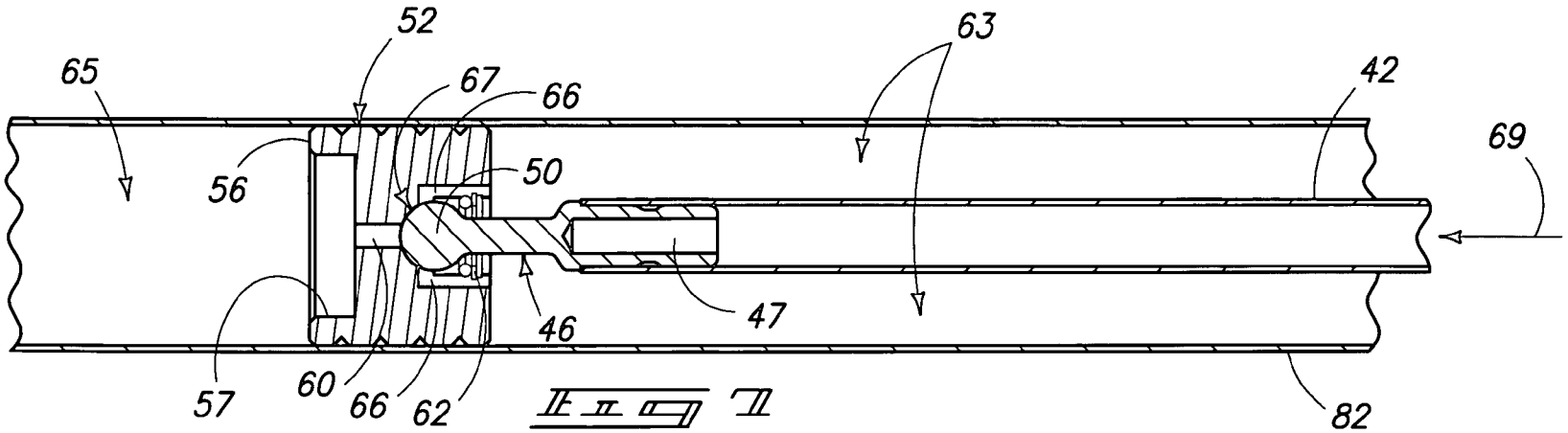

Referring to FIGS. 6 and 7, the capability of the ball portion 50 of bearing 46 to move forward and backward within the piston head 52 is illustrated. FIG. 6 illustrates action on the piston device 40 within cylinder 82 when the drawstring 22 of archery bow 12 (FIG. 1) is drawn backwards to create potential energy in preparation for launching a projectile. FIG. 7 illustrates action on the piston device 40 within cylinder 82 when the drawstring 22 of archery bow 12 (FIG. 1) is released wherein potential energy is converted to kinetic energy with the movement of the drawstring and piston device 40 for launching a projectile.

Referring to FIG. 6, it first must be understood that piston head 52 separates the volume of cylinder 82 into two volumes. One volume 63 includes piston rod 42 and is adjacent a rear face 64 of piston head 52. The opposite volume 65 of cylinder 82 is adjacent rim 56 of piston head 52. Volume 63 is open to the ambient atmosphere of the bow 12 by first end 83 of cylinder 82 (FIG. 4), and therefore, an exemplary volume 63 is under atmospheric pressure and filled with air. However, volume 65 will vary between high pressure and low pressure and have various gradients of fluid pressure depending on the action of piston head 52. For example, as the drawstring 22 is being pulled or drawn away from bow 12 (FIG. 1), only piston rod 42 and bearing 46 initially moves in direction 61 until the ball portion 50 impacts a portion 62 of piston head 52. Upon impacting portion 62 of piston head 52, ball portion 50 applies a force on portion 62 of piston head 52 to move piston head 52 in direction 61.

Still referring to FIG. 6, in this position of ball portion 50, the two volumes 63 and 65 are in fluid communication by an interaction between cavity 57, piston bore 60 and channel portions 66 and 67 of piston head 52. At least one channel portion 66 opens to volume 63 through rear face 64 of piston head 52 and is in fluid communication with channel portion 67. Channel portion 67 is curved and the curvature is configured to mate with of an upper surface of ball portion 50 of bearing 46. With ball portion 50 against portion 62 of the piston head 52, channel portion 67 is open to channel portion 66 and volume 63. Since the channel portion 67, piston bore 60, cavity 57 and volume 65 are in fluid communication, volume 63 is in fluid communication with volume 65.

Still referring to FIG. 6, as piston head 52 moves in direction 61, the volume within cylinder 82 adjacent rim 56 of piston head 52, that is volume 65, increases. As volume 65 increases, fluid pressure correspondingly decreases. Once the fluid pressure in volume 65 drops below the fluid pressure in volume 63, the greater fluid pressure in volume 63 will drive fluid, in one example ambient air, from volume 63 along path(s) 68 to volume 65. Air moving from volume 63 to volume 65 during drawing of drawstring 22 has the advantage of providing air in volume 65 to be driven by piston head 52 and launching a projectile upon releasing of drawstring 22.

Referring to FIG. 7, drawstring 22 is released and applies a force on an end of piston rod 42 (not shown) opposite bearing 46 to begin moving piston rod 42 in direction 69. Initially, only piston rod 42 and bearing 46 move in direction 69 with ball portion 50 moving away from portion 62 of piston head 52. Ball portion 50 moves away from portion 62 until the curved front portion impacts, mates with and closes off the curved portion of channel 67. In this position, bearing 46 closes off fluid communication between volume 63 and volume 65. Moreover, ball portion 50 applies a force to the curved portion of channel 67 and begins driving piston head 52 in direction 69. As piston head 52 moves in direction 69, the volume 65 diminishes. Since fluid communication between volumes 63 and 65 is closed, the air in volume 65 is being compressed and driven in direction 69 toward launching a projection (not shown).

Referring to FIG. 8, the exemplary second modular structure 148 for apparatus 10 is illustrated according to one of various embodiments of the invention. The exemplary second modular structure 148 includes the projectile loading mechanism 150 and barrel 190. An exemplary barrel 190 is configured for paint balls and includes the open end 192 where paint balls are ejected from apparatus 10. An opposite end 193 of barrel 190 receives an o-ring 151 and is secured into an end of base block 152 through opening 182. Base block 152 will be secured to base plate 100 of fluid transference device 80 by screws 162. A keeper plate 157 is secured to a bottom surface or side 194 by screws 159, and bottom surface 194 will rest against base plate 100 upon attachment to fluid transference device 80. A primary finger 153 is secured in bottom surface 194 and a secondary finger is secured in keeper plate 157. A scope bracket 160 is secured on an upper surface of base block 152 by screws 161.

Still referring to FIG. 8, a rear or back surface 195 of base block 152 has an opening (not shown) to receive a nozzle sleeve 163 wherein the nozzle sleeve 163 receives a compression spring 164. A slide post 171 having a slide post insert 172 provided therein is secured in the nozzle sleeve 163 by screw 173. A nozzle 165 is secured against the rear surface 195 by screws 166. An exemplar nozzle 165 has a valve portion 174 that is positioned in or through compression spring 164 and nozzle sleeve 163. An exemplary nozzle 165 further includes a nozzle valve pin 167 that extends through opposites sides. The nozzle valve pin 167 is oriented substantially transverse to the valve portion 174 and receives a pair of retaining rings 169 (only one shown) at opposite ends of the nozzle valve pin 167 adjacent the opposite sides of the nozzle 165. A nozzle valve lever 158 is secured to one of the opposite ends of the nozzle valve pin 167 by screw 170. An exemplary lever 158 has a plunger 178 that extends from the lever 158 toward or against the nozzle 165 and is capable of axial movement relative the nozzle 165 within lever 158.

Still referring to FIG. 8, a first set of a plurality of gradient grooves 175 are spaced in an arc in one of the opposite sides of the nozzle 165. A second set of a plurality of gradient grooves are spaced in an arc in a side of the base block 152. Both first and second sets of the plurality of gradient grooves 175 form a single complete arc of gradient grooves 175 once the nozzle 165 is secured to the base block 152. It should be understood that nozzle valve lever 158 is capable of rotation about an axis established by the nozzle valve pin 167 wherein the pin 167 rotates within nozzle 165. It should be further understood that as an operator rotates the nozzle valve lever 158, the plunger 178 moves axially relative the nozzle 165 within lever 158 to move and settle into one of the gradient grooves 175 to set the pin 167 and lever 158 in a static position. However, upon applying a minimum twisting or turning force on lever 158, the plunger 178 moves axial as it is forced against a rising surface adjacent each groove 175. The axial movement allows the plunger to move out of one groove 175 into any one of the other grooves 175 as the lever is positioned over the other groove 175 which again sets the pin 167 and lever 158 in a static different position.

Still referring to FIG. 8, base block 152 defines an opening 183 which is configured to receive paint balls. A base bracket 154 is positioned over opening 183 and secured to base block 152 with a pair of screws 176. Each screw 176 of the pair extends through a separate slot 185 (only one shown) in the base bracket 154 with each screw 176 secured into base block 152. The slots 185 allow for base bracket 154 to be moved and secured relative base block 152 in incremental positioned defined as an arc along the direction 181 illustrated in FIG. 1. An exemplary base bracket 154 has a collar 184 to receive an o-ring 177 and one end of housing or hopper 156 which allows hopper 156 to move along arrow 181 as illustrated in FIG. 1. Accordingly, hopper 156 can be positioned adjacent bow 12 or approximately 50° removed from bow 12. A collar 179 and hopper catch 180 are positioned in an end of hopper 156 opposite base bracket 154. Hopper catch 180 will retain paint balls in hopper 156 once they are placed in hopper 156.

Figure 9:
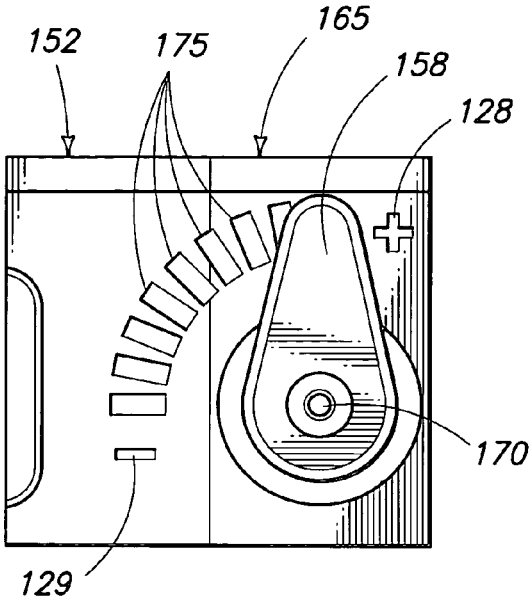
FIG. 9 is a side view of an exemplary nozzle according to one of various embodiments of the invention.

Referring to FIGS. 9, 9A, 10 and 10A, an exemplary nozzle 165 is more thoroughly discussed. Referring to FIG. 9, nozzle valve lever 158 is shown in an upright position proximate a "positive" (+) sign 128.

Figure 9A:
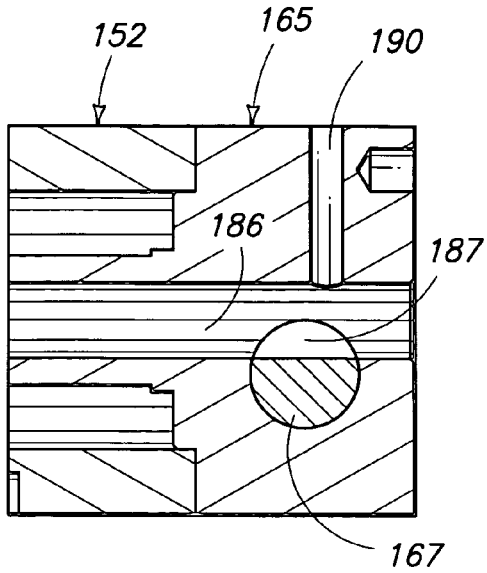
FIG. 9A is a vertical cross-sectional view of the exemplary nozzle of FIG. 9.

Referring to FIG. 9A, such illustrates the orientation of nozzle valve pin 167 in an exemplary bore 186 when nozzle valve lever 158 is oriented as shown in FIG. 9. It should be understood that bore 186 is actually two bore portions, one formed in nozzle 165 and another formed in base block 152 and then aligned to form a single bore 186. Bore 186 is in fluid communication with compression tube 80. It should be further understood that cavity 187 of nozzle valve pin 167 is configured to have generally the same curvature as bore 186. Consequently, in the orientation of FIG. 9A, cavity 187 of nozzle valve pin 167 is substantially aligned with the periphery of bore 186, and therefore, substantially no restriction of bore 186 occurs by nozzle valve pin 167.

Figure 10:
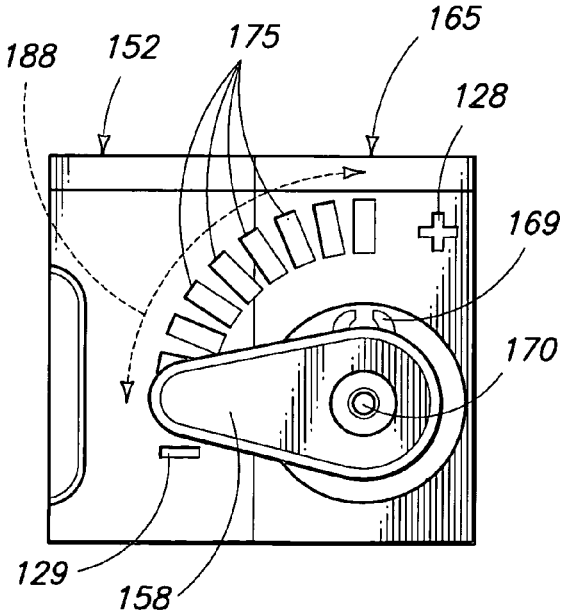
FIG. 10 is a side view of the exemplary nozzle of FIGS. 9-9A configured differently according to one of various embodiments of the invention.

Referring to FIG. 10, nozzle valve lever 158 has been rotated about 90° from the upright position of FIG. 9 to be positioned proximate a "negative" (−) sign 129. An exemplary nozzle valve lever 158 can be moved at least back and forth along direction 188.

Figure 10A:
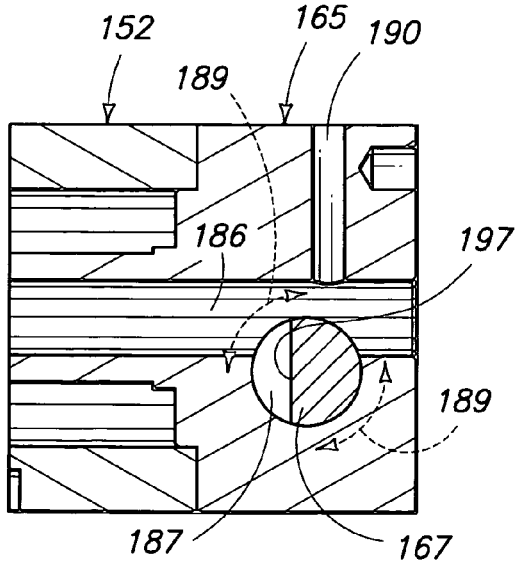
FIG. 10A is a vertical cross-sectional view of the exemplary nozzle of FIG. 10.
Figure 11:
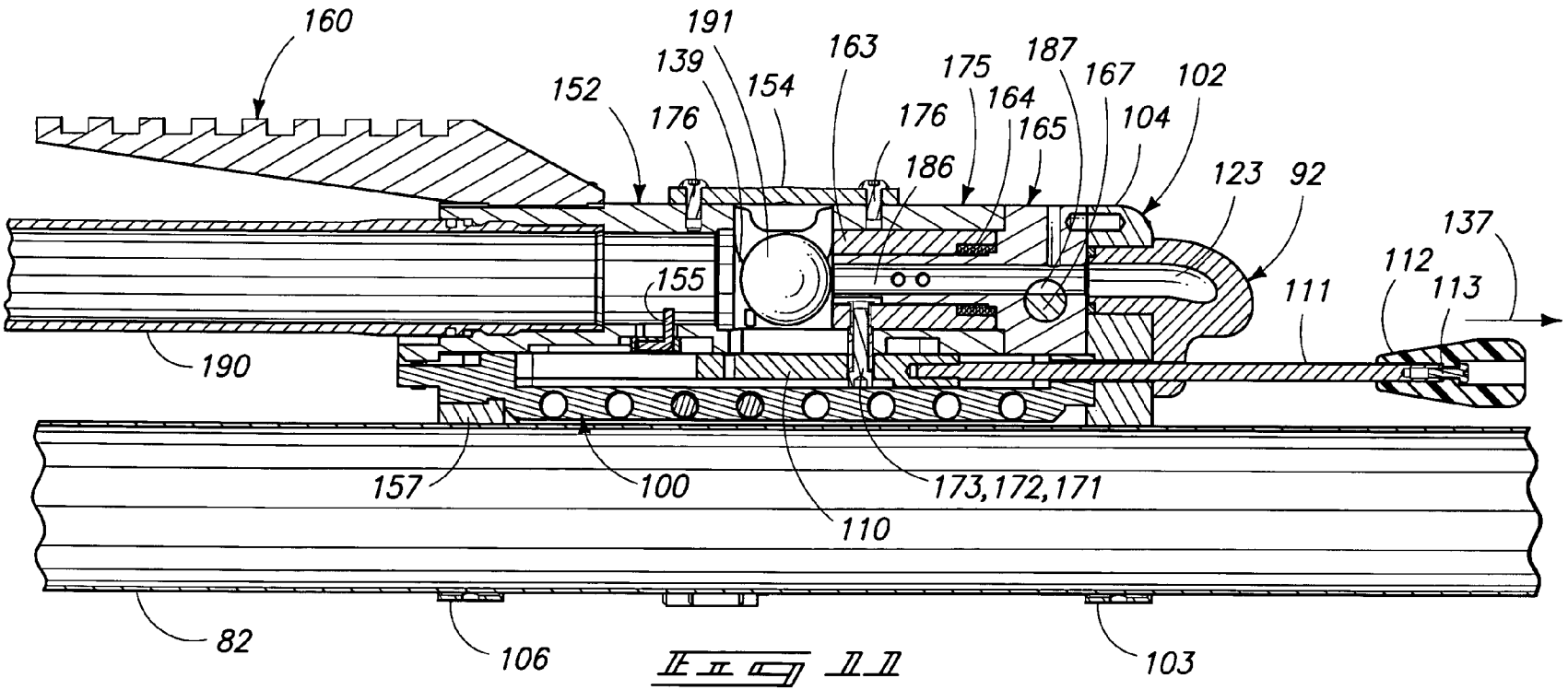
Figure 11:
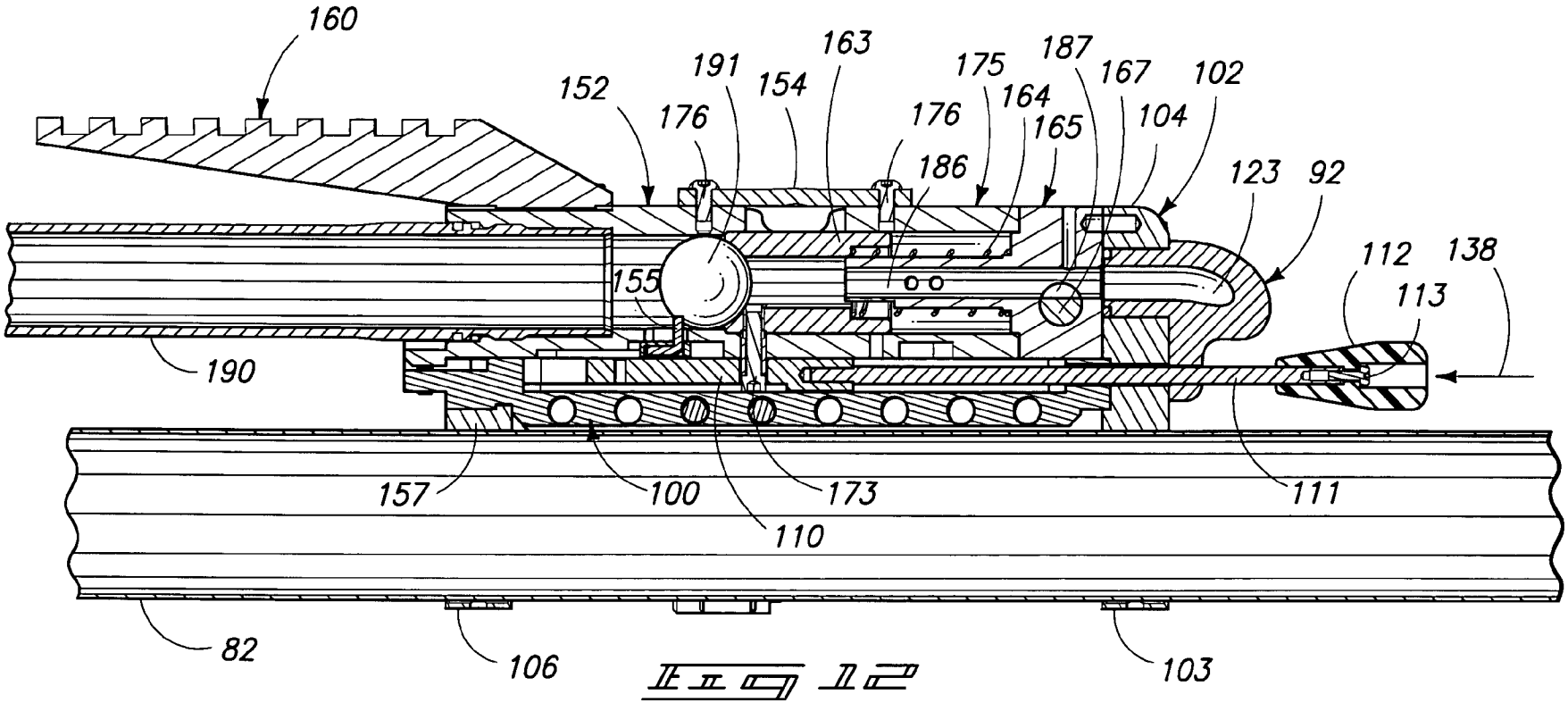
Figure 11:
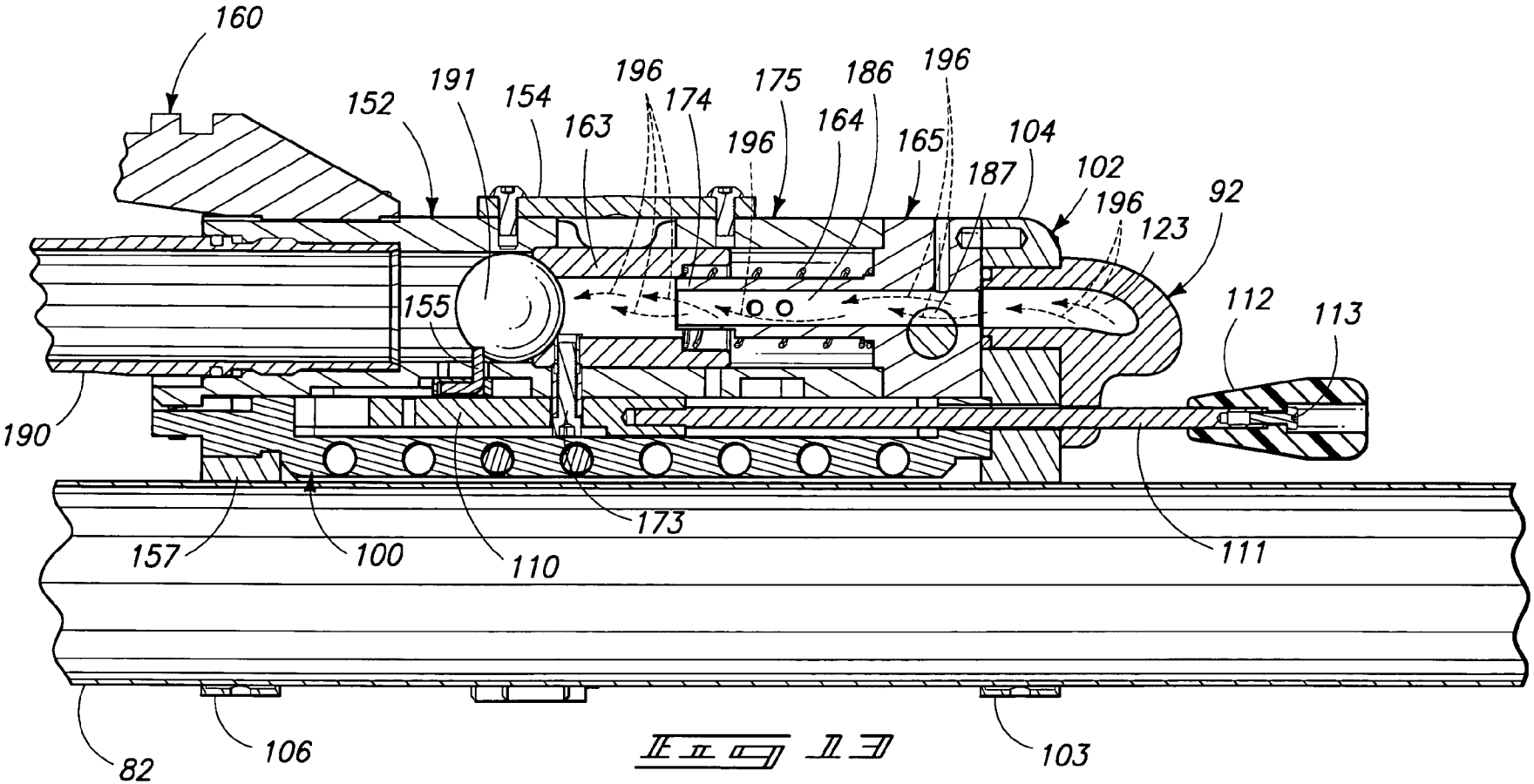
Figure 11:
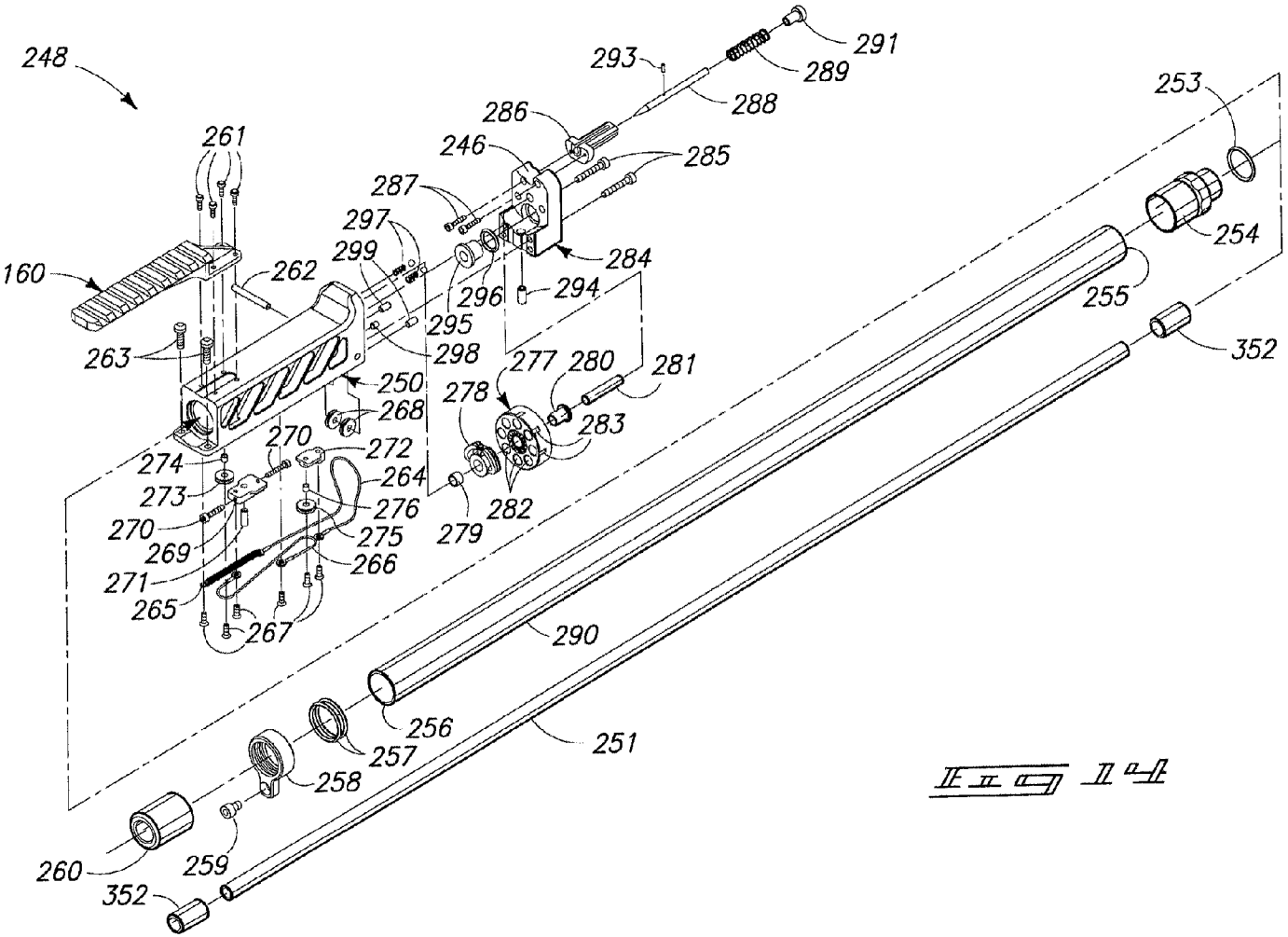

Referring to FIG. 1A, nozzle pin 167 can be moved at least back and forth along direction 189 which corresponds to movement of nozzle valve lever 158 along 188. With the orientation of valve lever 158 as illustrated in FIG. 10, nozzle pin 167 is oriented substantially 90° from the orientation of FIG. 9A, shown in FIG. 10A, wherein nozzle pin 167 substantially impedes or restricts bore 186. It should be understood that moving valve lever 158 from the position of FIG. 10 (from negative sign 129) to any one of the incremental positions of gradient grooves 175 toward positive sign 128 will angle a bottom surface 197 of cavity 187 of valve pin 167 relative the vertical position illustrated. Any position of the bottom surface 197 of cavity 187 which is angled relative the vertical position of FIG. 10A represents a lesser degree of restricting bore 186 by valve pin 167. That is, maximum restriction of bore 186 occurs when the cavity 187 valve pin 167 is oriented vertically or perpendicularly relative the longitudinal axis of bore 186 as illustrated in FIG. 10A.

Moreover, each incremental position of valve lever 158 which is closer to the positive sign 128 moves the bottom surface 197 of cavity 187 at a greater degree of angle relative the vertical position of FIG. 10A to provide a less degree of restriction to bore 186. It should be understood that as bore 186 becomes restricted by the orientation of valve pin 167, some of the fluid or air passing through bore 186 will be channeled through a passageway 198 to the atmosphere or ambient environment. The greater the cross-sectional area of bore 186 being restricted by valve pin 167, the greater the amount of air that will be channeled from bore 186 to the environment through passageway 198.

Figure 11:
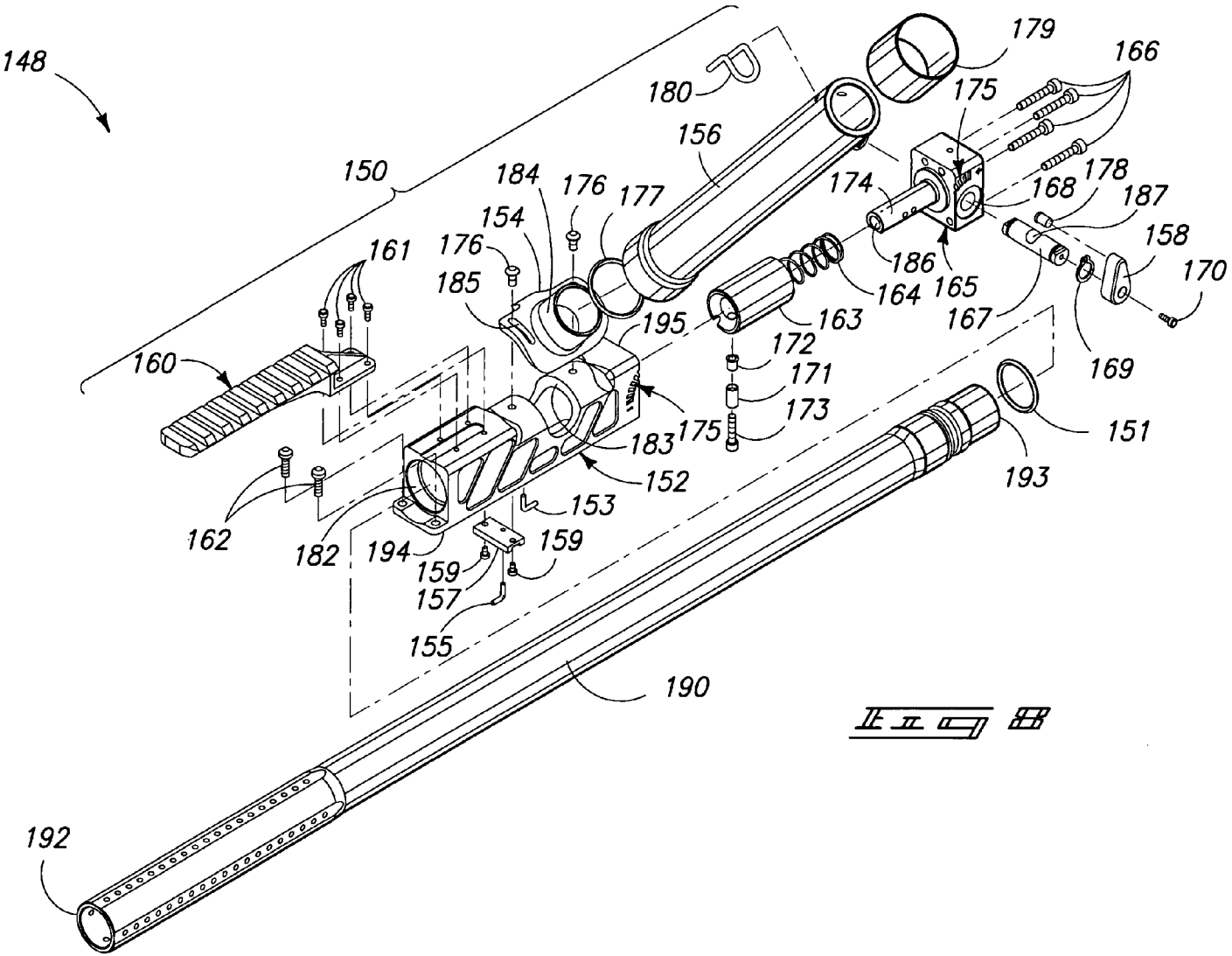
FIG. 11 is a fragmentary cross-sectional view of one of the exemplary various modular structures for launching projectiles according to one of the various embodiments of the invention.

Referring to FIG. 11, it should be understood that slide post 171, slide post insert 172 and screw 173 extend into base slide 110 and nozzle sleeve 163. By moving slide knob 112 in direction 137, slide post 171 moves the nozzle sleeve 163 in direction 137 to open chamber 139 to receive a paint ball 191 from hopper 156 (FIG. 1).

Figure 12:
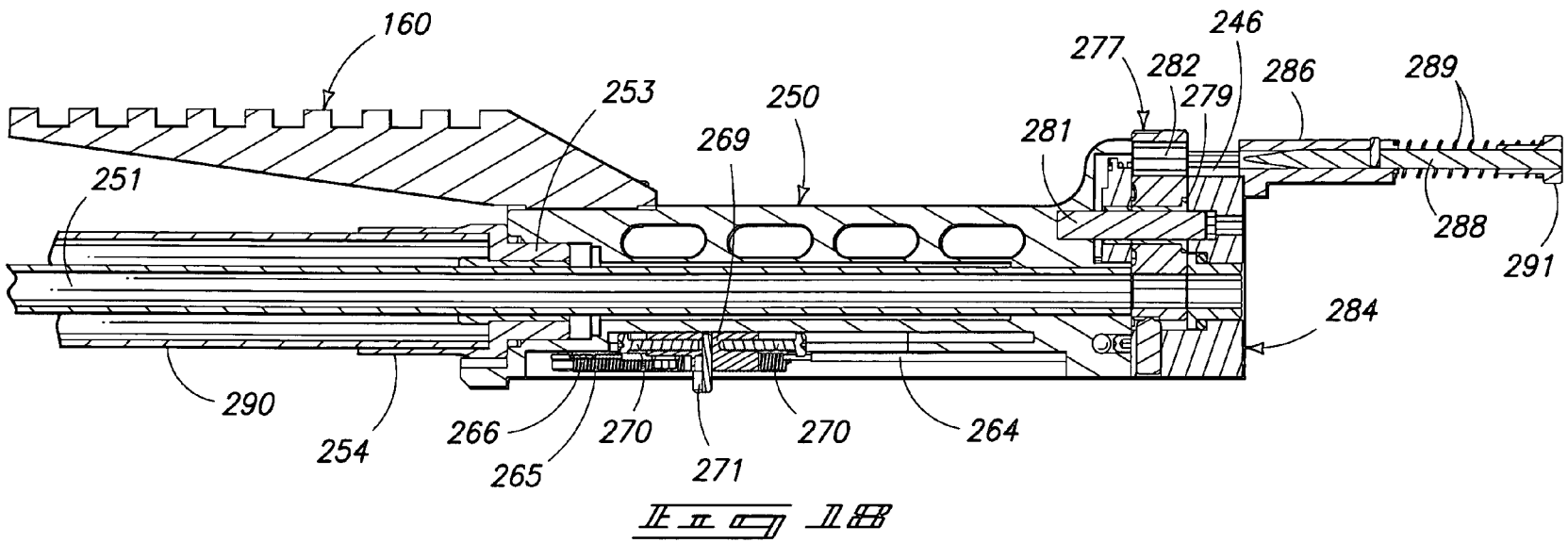
FIG. 12 is the modular structure of FIG. 11 configured differently.

Referring to FIG. 12, slide knob 112 is moved in direction 138 to move slide post 171 and nozzle sleeve 163 in direction 138 wherein slide post 171 and/or nozzle sleeve 163 contact paint ball 191. Slide post 171 and/or nozzle sleeve 163 will drive paint ball 191 to rest against secondary finger 155. In this position, paint ball 191 is at least partially in barrel 190 and is ready for launching.

Referring to FIG. 13, air flow 196 from compression tube 80 has entered opening or channel 123 of second fluid elbow 92 and bore 186 to impact and drive paint ball 191 through barrel 190.

Referring to FIG. 14, the exemplary second modular structure 248 for apparatus 210 is illustrated according to one of various embodiments of the invention. The exemplary second modular structure 248 includes the projectile loading mechanism 250, outer barrel 290 and inner barrel 251 which has a smaller diameter than outer barrel 290. An exemplary inner barrel 251 is configured for pellets and has a rifling pattern through a bore defined by the inner barrel 251.

Still referring to FIG. 14, an exemplary inner barrel 251 has opposite open ends, and each end receives a tension boss 352. Inner barrel 251 is positioned in outer barrel 290 and spaced from the periphery walls of the bore of the outer barrel 290. The space or region 249 (see FIG. 18) between the barrels 251 and 290 is filled with a dampening and/or insulative material (or buffer material), for example, polystyrene and/or polyurethane. A first end 255 of outer barrel 290 receives a barrel base fitting 254 and an o-ring 253, and is secured into projectile loading device 250 (or base block 250). An opposite end 256 of outer barrel 290 receives a pair of o-rings 257, barrel support 258 and barrel end fitting 260. An exemplary barrel support 258 includes a screw 259 to be secured to the end flange 87 of first modular structure 36 (see FIG. 4) wherein outer barrel 290 is secured and positioned in a spaced relationship relative the compression tube 80. An exemplary pellet will be ejected from end 256 and barrel end fitting 260 of outer barrel 290 after first being ejected from an end of inner barrel 251. A scope bracket 160 is secured on an upper surface of base block 250 by screws 261. Base block 250 will be secured to base plate 100 of fluid transference device 80 by screws 263.

Still referring to FIG. 14, it should be understood that inner barrel 251 is held in tension within outer barrel 290. This provides the advantage of the inner barrel 251 being pulled straight to provide a truer flight when a projectile such as a pellet is launched from the inner barrel 251. The inner barrel 251 has the tension bosses 352 glued approximately to each end. Each tension boss 352 has an external thread that matches or mates with internal threads in base fitting 254 and end fitting 260 provided on outer barrel 290. The inner barrel/tension boss assembly is placed inside the outer barrel 290. Base fitting 254 and end fitting 260 fit over the outside of barrel 290 so that the internal threads of base fitting 254 and end fitting 260 are then concentric with outer barrel 290. The tension bosses 352 are threaded into base fitting 254 and end fitting 260 of outer barrel 290 to align the inner barrel 251 concentric with outer barrel 290. Base fitting 254 and end fitting 260 are then turned (just like a nut and bolt action) which pulls the inner barrel 251 in tension and places the outer barrel 290 in compression. The dampening and/or insulative material is provided in the space or region 249 (see FIG. 18) between the inner barrel 251 and the outer barrel 290 to reduce or eliminate vibration of the inner barrel 251 which may occur under the tensile force or stress.

Figure 15:
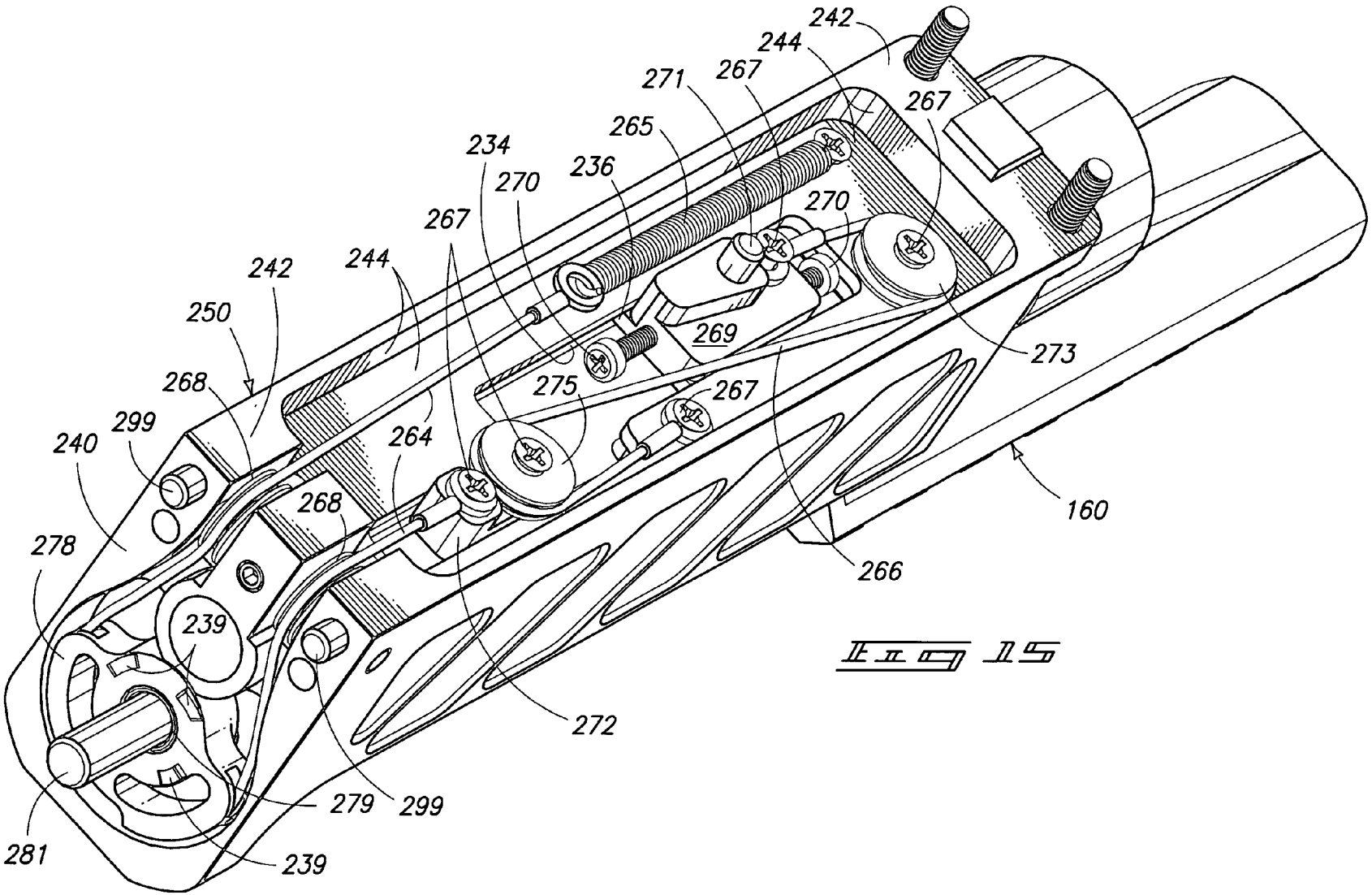
FIG. 15 is a perspective view of an exemplary underside of a projective loading device for launching projectiles according to one of the various embodiments of the invention.
Figure 11:
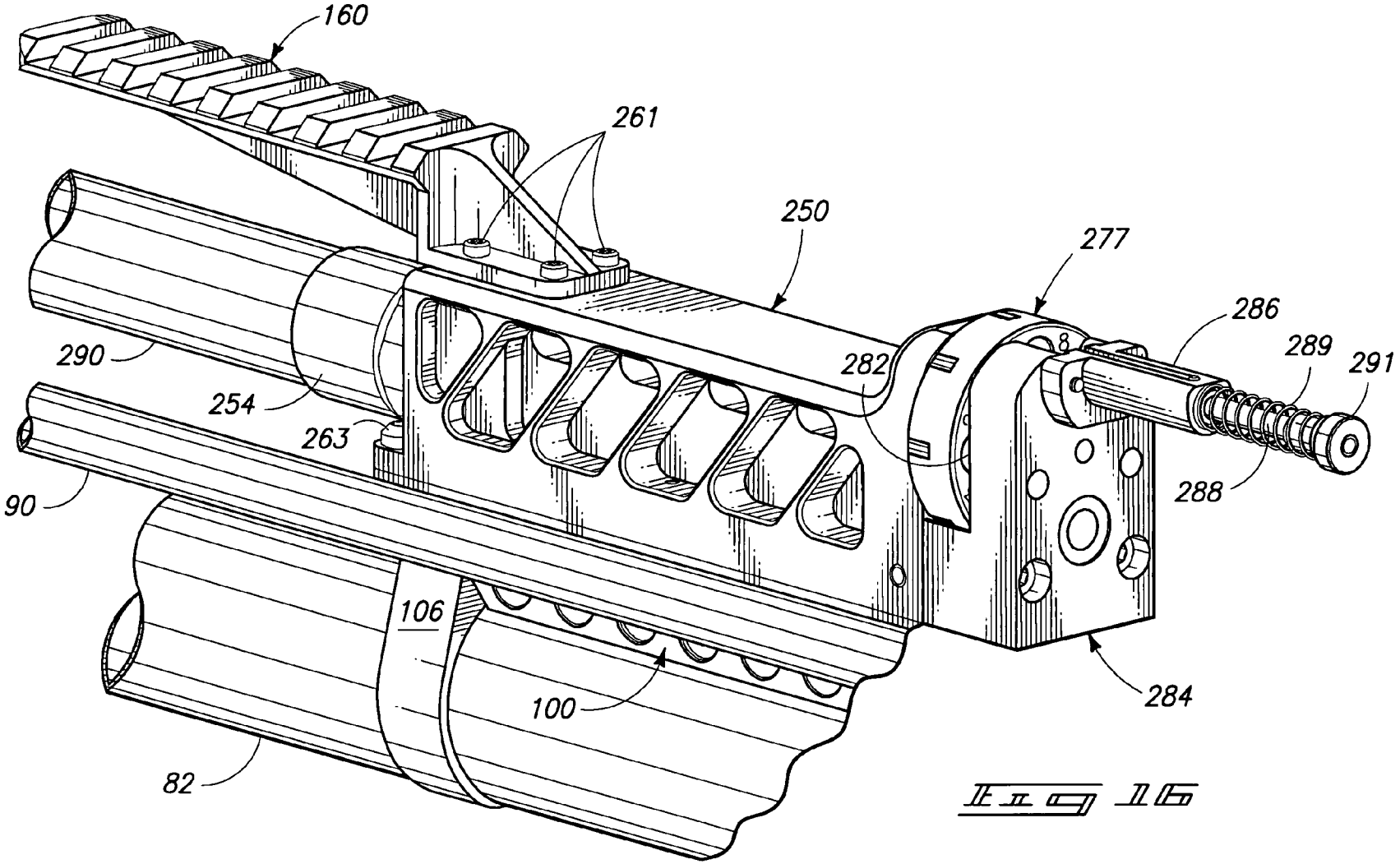
Figure 11:
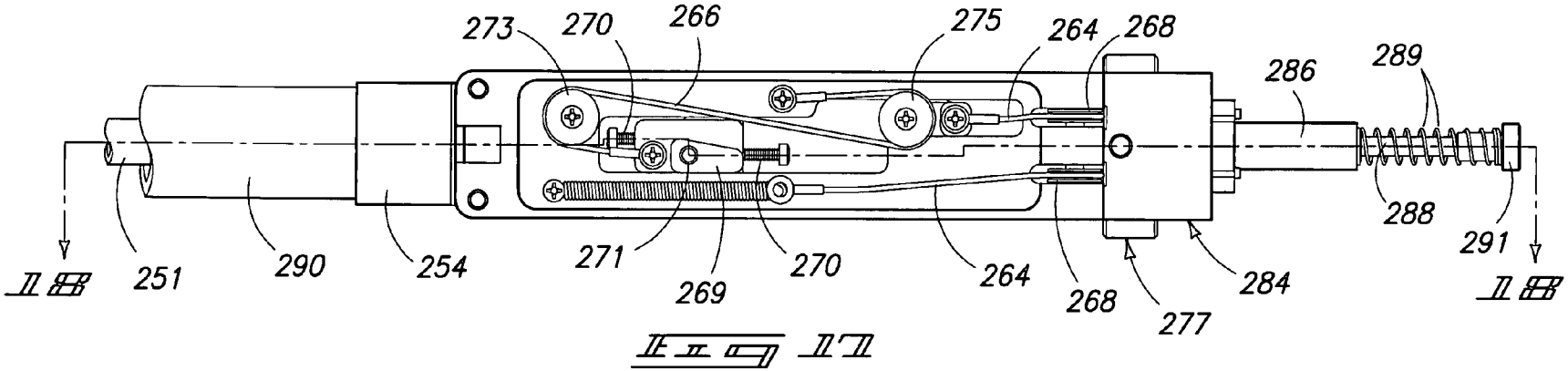

Referring to FIGS. 14-15 and 17, structures and parts are secured to the base block 250 (also referred to as the projectile loading device) in a bottom recess 244 formed in a bottom wall 242, and in and on a face 240 opposite the end receiving barrels 251 and 290. A primary slide 269 slidingly engages base block 250 by a pair of laterally extending wings 236 on opposite sides of primary slide 269. Each one of the pair of lateral wings 236 slidingly engages a groove 234 in base block 250. A dowel pin 271 extends from primary slide 269 and is configured to engage base slide 110 of base plate 100 of the first modular structure 36. A pulley 273 is rotatably secured to base block 250 by screw 267 at one end of recess 244 opposite face 240. Another pulley 275 is rotatably secured to a secondary slide 272 by another screw 267 at one end of recess 244 proximate face 240. Both pulleys 273 and 275 are generally oriented parallel to one another in the same plane. An exemplary secondary slide 272 slidingly engages base block 250 to move along an axis that is generally parallel and laterally spaced from the axis of movement by primary slide 269. A pair of stop screws 270 extend substantially axially and outwardly from opposite ends of primary slide 269 and act as stops of axial movement of the primary slide 269 by alternatively impacting respective edges formed in the recess 244 of base block 250.

Still referring to 14-15 and 17, a first end of a first cable 266 is anchored to primary slide 269 by screw 267 with cable portions extending around pulleys 273 and 275 to terminate with a second end of the first cable 266 being anchored to base block 250 in recess 244 by another screw 267. A pair of pulleys 268 are rotatably secured to base block 250 by a dowel pin 262 wherein the pair of pulleys 268 are oriented generally perpendicularly to pulleys 273 and 275 and oriented generally parallel to one another. The pair of pulleys 268 are positioned in spaced grooves formed in base block 250 that extend through a corner edge established by face 240 intersecting bottom wall 242. A first end of a second cable 264 is anchored to secondary slide 272 by screw 267 with a cable portion extending from secondary slide 272 generally parallel with bottom wall 242 to ride over one of the pair of pulleys 268 wherein a cable portion extends generally perpendicularly with bottom wall 242. The exemplary second cable 264 continues over a cylinder driver 278, over the other of the pair of pulleys 268 to extend generally parallel with bottom wall 242, and terminates to form a second end of the second cable 264 being anchored to a spring 265. An end of spring 265 opposite the second cable 264 is anchored to base block 250 in recess 244.

It should be understood that spring 265 provides a tensile force on second cable 264 which pulls secondary slide 272, and pulley 275 thereon, toward face 240 of base block 250. With pulley 275 being pulled toward face 240, first cable 266 is under tensile force which pulls primary slide 269 away from face 240 with one of the pair of stop screws 270 abutting or resting against an edge of base block 250. It should be further understood that dowel pin extending from primary slide 269 will be positioned in an opening in base slide 110 of base plate 100 of the first modular structure 36 (FIG. 11). In this configuration, moving knob 112 to move base slide 110 will move primary 269 toward face 240 in contradiction to the tensile force provided by spring 265. This movement of primary slide 269 will move the first and second cables 264 and 266, and move the secondary slide 272 which will rotate cylinder driver 278 on dowel pin 281 to ultimately rotate incrementally a pellet cylinder 277 described subsequently. Once knob 112 is released, the primary and secondary slides 269 and 272 return to the original static positions by the tensile force provided by spring 265 wherein primary slide 269 again rests against the edge of base block 250.

Still referring to 14-15 and 17, and particularly to FIG. 14, the pellet cylinder 277 is rotatably provided on cylinder bushing 280 and dowel pin 281. Dowel pin 281 extends through a central opening in pellet cylinder 277 with a portion of dowel pin 281 extending from one side of pellet cylinder 277 to receive a driver bushing 279 and the cylinder driver 278.

Referring to FIGS. 14, 15 and 16, pellet cylinder 277 is rotatably secured adjacent face 240 of base block 250 via dowel pin 281 and has a plurality of openings 282 to receive pellets and a plurality of detents on the circumferential periphery. A pellet base end 284 has a lower portion secured to base block 250 by screws 285 and an upper portion positioned adjacent a side of pellet cylinder 277 opposite the face 240 of base block 250. An o-ring 296 and flange seal 295 are positioned in an opening of pellet base end 284. A pellet seating base 286 is secured to an outer wall of pellet base end 284 by screws 287 and receives pellet seating pin 288, compression spring 289 and pellet pin knob 291.

Referring to FIG. 14, respective pulley spacers 274 and 276 are provided for respective pulleys 273 and 275 in base block 250. A set screw 298, a pair of dowel pins 299 and a pair of compression springs 297 are provided in base block 250 in the vicinity of face 240.

Referring to FIGS. 15-18, it should be understood that pellets will be individually provided in a pellet receiving area 246 of pellet base end 284 and then pellet pin knob 291 and pellet seating pin 288 will be driven toward the pellet receiving area 246 to contact the pellet therein. Accordingly, the pellet will be driven from the pellet receiving area 246 into one of the plurality of openings 282 of pellet cylinder 277. The primary slide 269 is moved to rotate the pellet cylinder 277 until one of the plurality of detents 283 engages plunger 294 (FIG. 14) and stops the rotation of the pellet cylinder 277 with another opening 282 aligned to receive another pellet provided in the pellet receiving area 246.

It should be understood that any one part or piece of first modular structure 36, and any one part or piece of second modular structure 148, and any one part or piece of second modular structure 248 can comprise a metal, a metal alloy, and/or a plastic material. An exemplary metal includes stainless steel, brass, copper, bronze, carbon steel and aluminum. An exemplary plastic material comprises nylon, Delrin, polyethylene, fiberglass and other polymers. It should be understood that the first modular structure 36, the second modular structure 148, and the second modular structure 248 all can be used by a right-handed operator with a righted-handed bow structure, and alternatively, all can be used by a left-handed operator with a left-handed bow structure.

Other perspectives or characterizations of expressing methods of operating the respective apparatuses 10 and 210 according to various embodiment of the invention is presented. The operation of apparatus 210 for launching a pellet is first discussed. In an initial step, the first modular structure 36 and the second modular structure 248 are secured to bow 12 by aligning openings in riser plate 117 over berger holes in riser 18. Riser plate 117 is securely attached to the archery bow riser 18 using the existing berger holes that are threaded into most common bow risers 18. The piston device 40 is securely attached to the drawstring 22 of the archery bow 12. With the use of the riser plate 117, the mounting bracket 115 and the bracket adjustment device 116, the first modular structure 36 and the second modular structure 248 are adjustable in three dimensions relative to the riser 18 and the drawstring 22.

The second modular structure 248 includes the projectile loading device or pellet receiver for the pellet apparatus 210 and is a machine that allows pellets to be loaded, staged for firing and fired into a rifled barrel. The main areas of the pellet receiver are the loading apparatus, the staging cylinder, the staging cylinder advancement and location mechanism and the barrel. An exemplary pellet includes a cylindrical shaped projectile made from lead or other metallic materials and placed into a pellet staging trough. The pellet staging tough is part of the body structure of the pellet receiver. Referring to FIGS. 14-18, the pellet loading apparatus consists of a body 286, pin 288, spring 289, knob 291 and an anti-twist pin (not shown). The pellet loading apparatus pushes the pellet from the trough into the pellet cylinder. The pellet loading apparatus can be adjusted to set the depth that the pellet is pushed into the pellet cylinder. The depth is adjusted to allow the pellet loading apparatus to seat pellets properly made to different specifications and by different manufacturers. The depth is adjusted by turning the knob which lengthens or shortens the distance that the pellet loading apparatus can travel. The travel of the pellet loading apparatus stops when the knob hits the body and does not allow further travel. The anti-twist pin prevents the pin from twisting when the knob is rotated.

The pellet cylinder 277 is a plastic or metal cylinder that rotates about a hole in the center of the cylinder. There are 2 to 20 holes arrayed about the centerline of the cylinder that stage the pellets for shooting. An alignment feature is part of the periphery or face of the cylinder that interfaces with an alignment pin or ball that is part of the receiver to accurately rotationally position the cylinder. Notches or detents 283 are cut into the face or periphery of the cylinder to interface with the advancement dog or cylinder driver 278 which advances the cylinder in a single direction. In an exemplary embodiment of the advancement dog or cylinder driver 278, the cylinder driver 278 rocks back and forth on the same centerline as the pellet cylinder 277 and has teeth 239 that engage with the notches on the pellet cylinder. The dog can move axially relative to the pellet cylinder and is forced by spring pressure towards the pellet cylinder. The rotational position of the advancement dog is controlled by a metal cable 264 that sits into a groove in the dog and is secured to the dog. The linear movement of the cable causes the dog to rotate about its centerline. When the dog is rotated in one direction, the teeth engage with the notches in the pellet cylinder and rotate the pellet cylinder. When the dog is rotated in the opposite direction, the teeth disengage from the notches of the pellet cylinder, pushing the dog away from the pellet cylinder against the spring pressure, allowing the dog to rotate without rotating the pellet cylinder. The dog rotates until the teeth fall back into the notches and it is staged to rotate the cylinder again.

The advancement dog cables 264 and 266 are actuated by a system of slides, pulleys and cables. The primary slide 269 is attached to a cable such that when the slide moves in a linear fashion, it causes the cable to move in a linear fashion. The cable is routed with a speed reduction 272 and a series of pulleys to the advancement dog. The back and forth movement of the primary slide causes the advancement dog to rotate back and forth. A pellet staged in the pellet cylinder is directly in line with a metal barrel assembly. The barrel assembly contains an inner, rifled barrel 251, an outer support barrel 290, threaded bosses on each end and dampening material. The inner barrel is a long, hollow cylinder with an inside surface configured with helical grooves that run the length of the barrel. The inner barrel runs through the outer barrel and is supported in tension in between the threaded bosses on each end and the outer barrel. A soft, plastic dampening material fills the space between the inner and outer barrels.

A plunger or piston head 52 can be made from metal or plastic of a variety of materials and is slightly smaller that the pressure tube 82, allowing it to move freely within the pressure tube. The plunger may or may not contain a seal to prevent or minimize the movement of air between the plunger and the pressure tube wall. The plunger is attached to the end of the plunger rod and is joined such that it can move at angles relative to the plunger rod.

The operator holds the archery bow 12 securely in one hand and pulls the drawstring 22 away from the riser 18. As the drawstring changes position relative to the bow riser (that is moving away from the riser 18), the plunger moves linearly through the pressure tube creating a cavity of lower air pressure relative to atmospheric pressure. Concurrently, the linear action of the plunger causes a one way valve to open in the plunger allowing atmospheric air to pass by the piston head 52, filling the low pressure chamber in the pressure tube with atmospheric air. The archery bow now has substantial potential energy stored in the limbs of the bow and the pressure tube is filled with air.

The operator releases the drawstring and the potential energy stored in the bow limbs is transferred into kinetic energy and linear motion in the drawstring. The plunger attached to the drawstring moves with great speed and force into the pressure tube. This action causes the valve in the plunger to close, restricting the flow of air through the plunger. The air that had been drawn into the pressure tube is forced into a smaller diameter tube 90 through a fitting 86 that gradually reduces the diameter of air flow. The reduction of air flow diameter greatly increases the velocity of the air. The high velocity air is routed through a tube 92 to the pellet receiver.

The high pressure air then moves through the receiver, where the pellet lies directly in its path. The pellet is held in a chamber that is approximately the same diameter as the pellet. The similarity in size between the pellet and the chamber creates a seal between the pellet and the chamber walls causing pressure to build behind the pellet. The differential in pressure on each side of the pellet causes the pellet to move away from the receiver at a high rate of speed. It travels through the aforementioned barrel and exits the barrel into the atmosphere.

The operation of apparatus 10 for launching a paintball is now discussed. The paintball apparatus bracket or second modular structure 148 is securely attached to an exemplary bow riser 18 using the existing berger holes that are threaded into most common bow risers. The plunger shaft or piston rod 42 is securely attached to the drawstring 22 of the archery bow 12. As stated previously, modular structures can be adjusted in three dimensions relative to the riser 18 and the drawstring 22.

Referring to FIGS. 1 and 8-13, a paintball 191 includes a spherical projectile comprised of an outer skin with a viscous jelly core generally about 0.69 inch in diameter. The paintball is placed into a cylindrical staging chamber called a hopper 156. The hopper can hold up to 10 paintballs and is made from plastic, metal or other structural type materials. The hopper attaches over a hollow cylindrical feature or collar 184 of a base bracket 154 that is attached to the paintball receiver 150. This base bracket 154 can be adjusted approximately 45 to 50 degrees to change the angle of the hopper relative to the receiver. The other end of the hopper has a rubber or plastic finger 180 that restricts movement of the paintballs and prevents the paintballs from falling out once loaded. After the paintballs are loaded into the hopper, the receiver handle 112 is pulled, which moves the position of the slide 163, allowing a paintball to drop into the firing chamber 139. A rubber finger 153 restricts multiple paintballs from entering the firing chamber. The receiver handle is then pushed forward, moving the slide forward which then pushes the paintball forward past the rubber finger. A second rubber finger 155 prevents the paintball from rolling forward into the barrel. The apparatus is now loaded and ready to shoot.

A plunger 52 is made from metal, plastic and is slightly smaller than the pressure tube 82 allowing it to move freely within the pressure tube. The plunger has a seal to minimize the movement of air between the plunger and the pressure tube wall. The plunger is attached to the end of a plunger rod 42 and is joined with a bearing 46 such that it can move at an angle relative to the plunger rod.

The operator holds the archery bow 12 securely in one hand and pulls the drawstring 22 away from the bow. As the drawstring 22 changes position relative to the bow riser 18, the plunger moves linearly through the pressure tube creating a cavity of lower air pressure relative to atmospheric pressure. Concurrently, the linear action of the plunger causes a one way valve to open in the plunger allowing atmospheric air to pass by the plunger, filling the low pressure chamber in the pressure tube with atmospheric air. The archery bow now has substantial potential energy stored in the limbs 14 of the bow and the pressure tube is filled with air.

The operator releases the drawstring 22 and the potential energy stored in the bow limbs is transferred into kinetic energy and linear motion in the drawstring 22. The plunger attached to the drawstring 22 moves with great speed and force into the pressure tube. This action causes the valve in the plunger to close and restricting the flow of air through the plunger. The air that had been drawn into the pressure tube is forced into a smaller diameter tube 90 through a fitting 86 that gradually reduces the diameter of air flow. The reduction of air flow diameter greatly increases the velocity of the air. The high velocity air is routed through a tube 92 to the paintball receiver 150.

The paintball receiver consists of plastic and metal parts whose function is to load and position a paintball for shooting. The receiver also routes that high velocity air to a position whereby it can act on the paintball. As the high velocity air travels into the receiver, it crosses holes that fill a chamber behind the slide with air and allows the pressure to equalize on both sides of the slide. The high pressure air then moves through the receiver where the paintball is directly in its path. The paintball is held in a chamber that is approximately the same diameter as the paintball. The similarity in size between the paintball and the chamber creates a seal between the paintball and the chamber walls causing pressure to build behind the paintball. The differential in pressure on each side of the paintball causes the paintball to move away from the receiver at a high rate of speed. It travels through a cylindrical shaped barrel and exits the barrel into the atmosphere.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is; therefore, claimed in any of its forms or modifications within the proper scope of the appended claims appropriately interpreted in accordance with the doctrine of equivalents.

The invention claimed is:

1. An apparatus for launching projectiles, the apparatus comprising:

a hollow cylinder;

a piston in sliding engagement through the hollow cylinder and configured to drive a fluid through the hollow cylinder;

a barrel defining an open end and a chamber in fluid communication with the hollow cylinder, the chamber configured to receive a projectile and to receive fluid driven from the hollow cylinder wherein the projectile is driven from the barrel through the open end;

a valve configured to selectively restrict or obstruct the chamber incrementally, the valve positioned downstream from the piston; and wherein the valve comprises a longitudinal pin configured to rotate about the longitudinal axis to incrementally obstruct the chamber.

2. The apparatus of claim 1 wherein the hollow cylinder is removably secured to a bow structure.

3. The apparatus of claim 1 wherein the piston comprises a piston head and a piston rod having a first end pivotally secured to the piston head, the piston rod comprising a second end opposite the first end, the second end removably secured directly to a drawstring of a bow structure.

4. The apparatus of claim 1 wherein the hollow cylinder is separate and discrete from the barrel, and wherein the hollow cylinder is removably secured to the barrel.

5. The apparatus of claim 1 further comprising:

another hollow cylinder that receives the barrel, the barrel being positioned in a spaced relationship from an inner periphery of the another hollow cylinder; and an insulative material in the space between the barrel and the inner periphery of the another hollow cylinder.

6. The apparatus of claim 5 wherein the insulative material comprises at least one of polystyrene and polyurethane.

7. The apparatus of claim 1 wherein the barrel comprises rifling.

8. The apparatus of claim 1 wherein the projectile comprises one of a pellet and a paint ball.

9. The apparatus of claim 1 further comprising a cylinder configured in a rotatable relationship with the barrel, the cylinder comprising a plurality of openings to receive projectiles in a launching relationship through the barrel.

10. The apparatus of claim 1 further comprising a tube providing fluid communication between the barrel and the hollow cylinder, the tube comprising a longitudinal structure extending generally parallel with one of the barrel and the hollow cylinder.

11. The apparatus of claim 1 wherein the barrel is a discrete structure relative the hollow cylinder, and further comprising a tube providing fluid communication between the barrel and the hollow cylinder, the tube comprising a discrete structure relative the barrel and the hollow cylinder.

12. The apparatus of claim 1 wherein the valve comprises a lever for manual operation of the valve.

13. An apparatus for launching projectiles, the apparatus comprising:

a hollow cylinder;

a piston in sliding engagement through the hollow cylinder and configured to drive a fluid through the hollow cylinder;

a barrel defining an open end and a chamber in fluid communication with the hollow cylinder, the chamber configured to receive a projectile and to receive fluid driven from the hollow cylinder wherein the projectile is driven from the barrel through the open end;

a valve configured to selectively restrict or obstruct the chamber incrementally, the valve positioned downstream from the piston; and wherein the valve comprises a longitudinal pin having a cavity, the cavity having curvature dimensions the same as the chamber.

14. The apparatus of claim 13 wherein the hollow cylinder is removably secured to a bow structure.

15. The apparatus of claim 13 further comprising:

another hollow cylinder that receives the barrel, the barrel being positioned in a spaced relationship from an inner periphery of the another hollow cylinder; and an insulative material in the space between the barrel and the inner periphery of the another hollow cylinder.

16. The apparatus of claim 13 further comprising a cylinder configured in a rotatable relationship with the barrel, the cylinder comprising a plurality of openings to receive projectiles in a launching relationship through the barrel.

17. An apparatus for launching projectiles, the apparatus comprising:

a hollow cylinder;

a piston in sliding engagement through the hollow cylinder and configured to drive a fluid through the hollow cylinder;

a barrel defining an open end and a chamber in fluid communication with the hollow cylinder, the chamber configured to receive a projectile and to receive fluid driven from the hollow cylinder wherein the projectile is driven from the barrel through the open end;

a valve configured to selectively restrict or obstruct the chamber incrementally, the valve positioned downstream from the piston; and wherein the valve comprises a longitudinal pin, and wherein the pin comprises a first position that provides minimal obstruction to the chamber and a second position that provides maximum obstruction to the chamber, and the difference between the first and second positions is a rotation about the longitudinal axis of about 90 degrees.

18. The apparatus of claim 17 wherein the hollow cylinder is removably secured to a bow structure.

19. The apparatus of claim 17 further comprising:

another hollow cylinder that receives the barrel, the barrel being positioned in a spaced relationship from an inner periphery of the another hollow cylinder; and an insulative material in the space between the barrel and the inner periphery of the another hollow cylinder.

20. The apparatus of claim 17 further comprising a cylinder configured in a rotatable relationship with the barrel, the cylinder comprising a plurality of openings to receive projectiles in a launching relationship through the barrel.

21. An apparatus for launching projectiles, the apparatus comprising:

a hollow cylinder;

a piston in sliding engagement through the hollow cylinder and configured to drive a fluid through the hollow cylinder;

a barrel defining an open end and a chamber in fluid communication with the hollow cylinder, the chamber configured to receive a projectile and to receive fluid driven from the hollow cylinder wherein the projectile is driven from the barrel through the open end;

a valve configured to selectively restrict or obstruct the chamber incrementally, the valve positioned downstream from the piston; and wherein the valve comprises:

a body secured to the barrel and comprising a plurality of grooves;

a lever for manual operation of the valve and located outward of the body; and a plunger extending from the lever and biased against the body, the plunger is configured to rest in one of the plurality of grooves.

22. The apparatus of claim 21 wherein the hollow cylinder is removably secured to a bow structure.

23. The apparatus of claim 21 further comprising:

another hollow cylinder that receives the barrel, the barrel being positioned in a spaced relationship from an inner periphery of the another hollow cylinder; and an insulative material in the space between the barrel and the inner periphery of the another hollow cylinder.

24. The apparatus of claim 21 further comprising a cylinder configured in a rotatable relationship with the barrel, the cylinder comprising a plurality of openings to receive projectiles in a launching relationship through the barrel.

* * * * *

UNITED STATES PATENT AND TRADEMARK OFFICE

CERTIFICATE OF CORRECTION

PATENT NO. : 8,485,171 B2
APPLICATION NO. : 12/224450
DATED : July 16, 2013
INVENTOR(S) : Devon Romney It is certified that error appears in the above-identified patent and that said Letters Patent is hereby corrected as shown below:

In the Specification

Column 2, line 45 – Replace ""to promote" the" with --"to promote the--

Column 5, line 37 – Replace "unshaped" with --u-shaped--

Column 5, line 38 – Replace "unshaped" with --u-shaped--

Column 8, line 24 – Replace "FIG. 1A," with --FIG. 10A,--

Column 11, line 64 – Replace "staging tough" with --staging trough--

Signed and Sealed this
Thirty-first Day of December, 2013

Margaret A. Focarino

Margaret A. Focarino
*Commissioner for Patents of the United States Patent and Trademark Office*